US008695904B2

(12) United States Patent
Davis et al.

(10) Patent No.: US 8,695,904 B2
(45) Date of Patent: Apr. 15, 2014

(54) MOBILE CRUSHING STATION

(75) Inventors: Glenn Davis, Spokane, WA (US); Thomas Steele, Twentynine Palms, CA (US); Jacob Culley, Spokane, WA (US)

(73) Assignee: FLSmidth A/S, Valby (DK)

( * ) Notice: Subject to any disclaimer, the term of this patent is extended or adjusted under 35 U.S.C. 154(b) by 442 days.

(21) Appl. No.: 13/063,557

(22) PCT Filed: Sep. 16, 2009

(86) PCT No.: PCT/US2009/005151

§ 371 (c)(1),
(2), (4) Date: Apr. 8, 2011

(87) PCT Pub. No.: WO2010/033177

PCT Pub. Date: Mar. 25, 2010

(65) Prior Publication Data

US 2011/0174907 A1 Jul. 21, 2011

Related U.S. Application Data

(60) Provisional application No. 61/192,279, filed on Sep. 17, 2008.

(51) Int. Cl.
*B02C 21/02* (2006.01)

(52) U.S. Cl.
USPC ..... 241/34; 241/101.74

(58) Field of Classification Search
USPC ..... 241/101.71, 101.74, 101.741, 101.75, 241/101.76, 34
See application file for complete search history.

(56) References Cited

U.S. PATENT DOCUMENTS

| | | | | |
|---|---|---|---|---|
| 4,606,133 | A | 8/1986 | Mills | |
| 4,763,845 | A | 8/1988 | Guggenheimer et al. | |
| 4,899,942 | A | 2/1990 | Bohringer | |
| 4,909,449 | A * | 3/1990 | Etheridge | 241/34 |
| 5,560,551 | A | 10/1996 | Suverkrop | |
| 5,647,545 | A | 7/1997 | Conner | |
| 5,911,373 | A | 6/1999 | Reid | |
| 6,626,608 | B2 | 9/2003 | Olynyk | |
| 2005/0261872 | A1 | 11/2005 | McIsaac et al. | |

OTHER PUBLICATIONS

International Search Report of PCT/US2009/05151 dated Nov. 13, 2009.
Written Opinion of the International Searching Authority for PCT/US2009/05151 dated Nov. 13, 2009.

* cited by examiner

*Primary Examiner* — Mark Rosenbaum
(74) *Attorney, Agent, or Firm* — Buchanan Ingersoll & Rooney PC

(57) ABSTRACT

A mobile crushing station for receiving and comminuting excavated material from earth moving vehicles provides at least one moveable skip connected to a chassis or frame for receiving material from vehicles, such as rear unloading vehicles like dump trucks. The skips are configured to move to dump material fed into the skips into a feed hopper. The feed hopper is positioned to guide material onto a feed conveyor, such as an inclined apron conveyor. The feed conveyor is configured to transport material to a feed orifice of a crushing device, such as a sizer, a crusher, or a crushing circuit. The crushing device is configured to crush material fed into the crushing device. The crushing device also has a discharge orifice that is positioned above a portion of a discharge conveyor. The mobile crushing station is moveable so it may be repositioned closer to an excavation site as excavation activities progress.

20 Claims, 20 Drawing Sheets

MOBILE CRUSHING STATION

CROSS REFERENCE TO RELATED APPLICATION

This application is the United States national stage under 35 U.S.C. §371 of International Application No. PCT/US2009/005151, filed on Sep. 16, 2009, which claimed priority to U.S. Provisional Patent Application No. 61/192,279, which was filed on Sep. 17, 2008. The entirety of these applications are incorporated by reference herein.

FIELD OF INVENTION

This invention relates to solid material comminution and disintegration, and more particularly to a mobile crushing station for receiving, comminuting and transporting excavated material.

BACKGROUND OF THE INVENTION

In mining minerals, ores, or other material it is often necessary to process the excavated material into more uniform size pieces for transport on conveyors and the like. Because material processing increases the cost of the operations it is imperative that material comminution and transport be as efficient as possible.

In open cut iron ore mines, coal mines, and mineral beneficiating mines huge volumes of material are excavated from a mine face and thereafter transported to a distal storage site, shipping site, or processing site.

Various apparatus and methods for comminuting and transporting excavated materials are known in the prior art. U.S. Pat. Nos. 2,593,353, 3,510,073, 3,752,334, 4,059,195, 4,383,651, 4,491,279, 4,669,674, 4,712,744, 4,721,201, 4,881,691, 5,580,004, 5,797,548, 5,803,376, 5,911,373, 7,278,596 disclose examples of such apparatuses. Such apparatus and typically include a rock crusher, communicating with conveyor systems for crushing and thereafter transporting the material to a location distal from the excavation and crushing site.

Material may be excavated from a mine face using machines such as drag lines, front-end loaders and mechanical shovels. Blasting with explosives may precede excavation. When the distance between the mine face and rock crusher is not overly large, the excavated material may be deposited directly into the rock crusher by the excavating machines. However, as the mine face advances due to continuous excavation and material removal, the distance the excavated material must be transported to the rock crusher increases which necessitates that the excavating machines traverse back and forth between the mine face and the rock crusher. Alternatively, transport vehicles such as dump trucks are employed to traverse the distance between the excavating machines at the mine face and the rock crusher. Unfortunately, as the distance increases efficiency decreases. To address this problem, additional transport vehicles may be employed or the rock crusher may be shut down, disassembled and moved to a position closer to the mine face and then reassembled to decrease transportation distances.

Rock crushers, also called crushing stations, crushing circuits, or sizers, generally comprise a vertical tower structure positioned immediately adjacent a reinforced vertical wall supporting a massive earthen ramp on the side opposite the tower structure. Earth moving vehicles, such as dump trucks loaded with excavated material, travel up the earthen ramp and back-up to a feed orifice at an upper end portion of the tower structure. The material is dumped into the crushing station's feed orifice and thereafter passes through a top size control aperture, also known as a grizzly, and into a rock crushing mechanism which comminutes the material into desirable sized pieces. The crushed material exits the crushing station through a lower discharge orifice spacedly below the feed orifice onto a conveyor for transfer to another site.

Relocation of a crushing station is an enormous and expensive undertaking requiring that a new reinforced vertical retaining wall and earthen ramp be built, at least partial disassembly of the tower structure, the loading of the tower structure and associated components on vehicles, the transport of the tower structure and components to the new location and reassembly. Auxiliary equipment, apparatus and facilities such as electrical generation stations, fuel tanks, access roads (entry and exit) and the like must also be relocated and perhaps constructed. During the relocation process the entire crushing station must be shut down, effectively stopping production of the entire mine and further decreasing efficiency.

Crushing stations, by their very nature are subject to significant amounts of "wear and tear" during normal operating conditions and require regular maintenance. Shutting down a crushing station so that it may be moved materially adds to the amount of unavoidable down time caused by foreseeable repair and maintenance. Such additional "down time" further increases costs and inefficiency and may make a project economically not viable.

There is a need for a system that can increase the efficiency of material comminution and transport for material excavation without incurring substantial costs of additional transport equipment such as additional dump trucks, or significant construction needs such as retaining wall and earthen ramp construction. Preferably, the system is configured to substantially reduce, if not eliminate, downtime caused by shutting down, disassembling, moving and reassembling a crushing station and its associated components, apparatus and facilities used in the comminution and transport of excavated material.

SUMMARY OF THE INVENTION

Embodiments of our invention can resolve several of the aforementioned problems with known crushing stations and known comminuting and transporting apparatus and methods. For example, embodiments of our mobile crushing station can provide a self-propelled, mobile crushing station having an integral rock crusher and discharge conveyor that is movable under its own power and may receive and comminute excavated material from multiple dump trucks at the same time. Embodiments of our mobile crushing station also do not need to be disassembled to be repositioned, and is structurally configured to distribute its mass and the mass of dump trucks and the material carried therein over a large area.

Embodiments of our mobile crushing station can also be configured to have minimal elevation above grade and may eliminate the need for constructing massive reinforced retaining walls and earthen ramps to permit mining and excavation operations to be performed more efficiently and more effectively. Instead, material can be displaced for a relatively shallow trench in which embodiments of our mobile crushing station may be positioned during operation. Such relatively shallow trenches can be configured to create low rise ramps so that dump trucks or other vehicles can easily access the skips of the mobile crushing station. In other embodiments, the mobile crushing station is sized and configured for operation without needing to be positioned in any trench. For instance, an embodiment of the mobile crushing station may be positioned on the ground. Embodiments of our mobile crushing station may also be quickly and inexpensively repositioned proximate to an excavation site at lower cost and without significant down time relative to prior art crushing stations.

One embodiment of our mobile crushing station is configured for receiving and comminuting excavated material from two earth moving vehicles, in particular dump trucks. The station can provide two spaced apart pivoting truck skips having hinged floors interconnected with a chassis having an elongate medial apron plate feeder and an operator positionable diverter gate for regulating feed rate and throughputs. The apron plate feeder communicates with a feed orifice of a sizer having two parallel oppositely rotatable rock crushing drums. A sizer discharge orifice is spacedly above one end portion of a discharge conveyor such that material crushed in the sizer is fed onto the discharge conveyor. A powered steerable car body type dual crawler track assembly can be interconnected to the chassis of the station proximate to each truck skip. A fixed powered crawler track assembly may also be is interconnected to the chassis proximate below the sizer.

One embodiment of the mobile crushing station can include a frame, a first skip, a second skip, a first skip lifting assembly, a second skip lifting assembly, a plurality of first cylinders, a plurality of second cylinders, a hopper, a feed conveyor, a crushing device and a discharge conveyor. The first and second skips are each sized and configured to receive material. The first skip lifting assembly is connected to the frame and connected to the first skip. The first skip lifting assembly is configured to move relative to the frame and to move the first skip from a first position to a second position. The second skip lifting assembly is connected to the frame and connected to the second skip. The second skip lifting assembly is configured to move relative to the frame and to move the second skip from a first position to a second position.

The first cylinders are moveably connected to the frame and are also connected to the first skip lifting assembly. Each first cylinder is configured to move from a retracted position to an extended position so that movement of the first cylinders to the extended position moves the first skip lifting assembly such that the first skip moves to the second position. The second cylinders are moveably connected to the frame and are also connected to the second skip lifting assembly. Each second cylinder is configured to move from a retracted position to an extended position such that movement of the second cylinders to the extended position moves the second skip lifting assembly so that the second skip moves to the second position.

The hopper is connected to the frame adjacent to the first skip and the second skip. The hopper has an upper opening sized and configured to receive material from at least one of the first skip and the second skip. The feed conveyor is connected to the frame adjacent to the hopper and is sized and configured to receive material from the hopper. The feed conveyor is moveable in a first direction to transport material in the first direction.

The crushing device is connected to the frame adjacent to the feed conveyor. The crushing device has a housing. The housing of the crushing device includes one or more feed openings and one or more discharge openings. The crushing device also has one or more crushing mechanisms attached to the housing between the one or more feed openings and one or more discharge openings such that material passing through the one or more feed openings is crushed before the material passes through the one or more discharge openings.

The discharge conveyor is connected to the frame adjacent to the crushing device. A portion of the discharge conveyor is positioned below the crushing device to receive material from the at least one or more discharge openings of the crushing device.

Embodiments of the mobile crushing station may include a plurality of jacks connected to the frame. The jacks may be moveable from a retracted position to an extended position. Movement of the jacks to the extended position may be configured to lift the mobile crushing station to permit a transport vehicle to lift, push, or pull the mobile crushing station.

Some embodiments of the mobile crushing station may include a plurality of tracks or crawlers connected to the frame. The tracks or crawlers may be pivotally coupled to the frame to permit the tracks or crawlers to pivot relative to the frame.

Preferably, embodiments of the mobile crushing station include an operator station connected to the frame such that the operator station is positioned above the first skip and the second skip when the first and second skips are in the first position. Such a position of the operator station permits operators that may be located in the station to oversee activities occurring during material loading and dumping operations. The position of the operation station may also permit an operator to oversee or monitor other operations or activities taking place during operation of the mobile crushing station.

Preferably, the first skip and the second skip each have a first side and a second side opposite the first side. The first skip lifting assembly can include a first member and a second member in embodiments of the mobile crushing station. The first member has a first end pivoted to the frame and a second end that is attached to a portion of the first skip adjacent to the first side of the first skip. The second member of the first skip lifting assembly has a first end pivoted to the frame and a second end that is attached to a portion of the first skip adjacent to the second side of the first skip. The second skip lifting assembly can also include a first member and a second member in embodiments of the mobile crushing station. The first member has a first end pivoted to the frame and a second end that is attached to a portion of the second skip adjacent to the first side of the second skip. The second member of the second skip lifting assembly has a first end pivoted to the frame and a second end that is attached to a portion of the first skip adjacent to the second side of the first skip.

Embodiments of the mobile crushing station can include one or more controllers configured to monitor or control certain activities or functions of the mobile crushing station. The one or more controllers may include a processing unit or processors coupled to memory. The memory may have software that is run by the processors or processor unit. The one or more controllers may be coupled to one or more input devices, such as buttons, switches, levers, key pads or keyboards. Preferably, at least some of the input devices are located in an operator station of the mobile crushing station. The one or more controllers may also be connected to one or more communication devices, such as display devices, such as monitors or screens, or audio output devices, such as speakers or loudspeakers.

Some embodiments of the mobile crushing station include one or more controllers coupled to at least one input device and at least one of the first cylinders and second cylinders. The one or more controllers are configured to actuate movement of at least one of the first cylinders and second cylinders after receiving lifting input from the input device. The input device may be, for example a computer mouse, a switch, a lever, a button, a keypad or a keyboard. The lifting input may be provided by a user entering a code via a keypad or keyboard. The lifting input may alternatively be input provided by a user pressing a button or moving a lever or switch.

Embodiments of the mobile crushing station may include an inclinometer connected to the frame and one or more controllers connected to the inclinometers. One or more communication devices may also be included. The one or more communication devices may be coupled to the one or more controllers. The one or more controllers may be configured to determine whether the frame is undergoing a predefined amount of racking and, if the at least one controller determines that the frame is experiencing at least the predefined amount of racking, the one or more controllers is configured to output an alert to the one or more communication devices to notify an operator. The alert may be a message that is signaled to the display device for displaying to a user. The alert may also, or alternatively, be an audio signal transmitted to a speaker.

Embodiments of the mobile crushing station may include one or more sensors positioned adjacent to the one or more feed openings of the crushing device and one or more controllers coupled to the one or more sensors and the feed conveyor. The one or more sensors are configured to measure a feed rate of material passing through the at least one feed opening. The at least one controller is configured to determine when the feed rate of material is equal to or under a first predefined feed rate amount and is configured to increase the feed conveyor speed in the first direction when the feed rate is determined to be below or equal to the first predefined feed rate amount. The controller may also be configured to determine whether the feed rate of material is over or equal to a second predefined feed rate amount. When the one or more controllers determine that the feed rate is equal to or over the second predefined feed rate amount, the one or more controllers can be configured to decrease feed conveyor speed in the first direction. It should be appreciated that the second predefined feed rate amount may be numerically different than the first predefined feed rate or may be the same value. The one or more controllers may also be configured to determine when a choking condition exists based on measurements received from the one or more sensors. The one or more controllers can be configured to cause the feed conveyor to move in a second direction that is opposite the first direction for a predefined period of time when the predefined choking condition is determined to exist.

Embodiments of the mobile crushing station may include a moveable gate. The moveable gate can be connected to the frame or the hopper. For instance, the moveable gate may be a tiltable diverter gate. As another example, the moveable gate may be a vibrating or vibratable screen positioned within or adjacent to an opening of the hopper.

Each skip may include a floor and a plurality of sidewalls adjacent to the floor in embodiments of the mobile crushing station. The sidewall and a portion of the floor of each skip may define a material receiving portion of that skip that is sized and configured to receive material and retain material until that skip is moved to the second position.

It should be appreciated that embodiments of the mobile crushing station may be mobile in different ways. For instance, the mobile crushing station may be sized and configured to permit a transport vehicle to lift and move the mobile crushing station. As another example, the mobile crushing station may be sized and configured to permit a vehicle to push or pull the mobile crushing station from a first location to a second location. As yet another example, the mobile crushing station may have tracks, wheels, crawlers or other movement mechanisms connected to the frame that permit the mobile crushing station to be driven to different locations.

Some embodiments of the mobile crushing station may only include one or more moveable skips. Those embodiments may include a frame, a skip, a skip lifting assembly, lifting mechanisms, a hopper, a feed conveyor, a crushing device and a discharge conveyor. The skip lifting assembly may be moveably connected to the frame and also attached to the skip. The lifting mechanisms may be moveably connected to the frame and attached to the skip lifting assembly. Each lifting mechanism is moveable from a first position to a second position to move the skip lifting assembly and lift the skips. The feed conveyor can be connected to the frame adjacent to the hopper. The crushing device may be connected to the frame adjacent to the feed conveyor. The feed conveyor is configured to move material to the crushing device. The discharge conveyor may be connected to the frame adjacent to the crushing device. The crushing device may include a housing that has one or more feed openings, one or more discharge openings and one or more crushing mechanisms between the one or more feed openings and one or more discharge openings. The discharge conveyor is configured to receive material from the one or more discharge openings.

Embodiments of the mobile crushing station may include at least one sensor connected to the at least one crushing mechanism and at least one controller coupled to the at least one sensor and to the feed conveyor. The one or more controllers are configured to determine when a predefined slow crushing condition exists. If the one or more controllers determine that a predefined slow crushing condition exists, the at least one controller is configured to reduce feed conveyor speed in the first direction. By reducing the feed conveyor speed, choking may be reduced or eliminated as a result of the detected slower crushing condition. For example, amperage filters or other sensors may be connected to crusher motors or other crushing mechanism components and to a controller. The controller may be configured to receive measurements from the amperage filters or other sensors to detect overloading of the crushing mechanism and automatically slow the apron plate feeder to prevent overloading and providing uninterrupted maximum throughput.

Other details, objects, and advantages of the invention will become apparent as the following description of certain present preferred embodiments thereof and certain present preferred methods of practicing the same proceeds.

BRIEF DESCRIPTION OF THE DRAWINGS

Present preferred embodiments of mobile crushing stations and methods of making and using such apparatuses are shown in the accompanying drawings in which.

DETAILED DESCRIPTION OF PRESENT PREFERRED EMBODIMENTS

Figure 1:
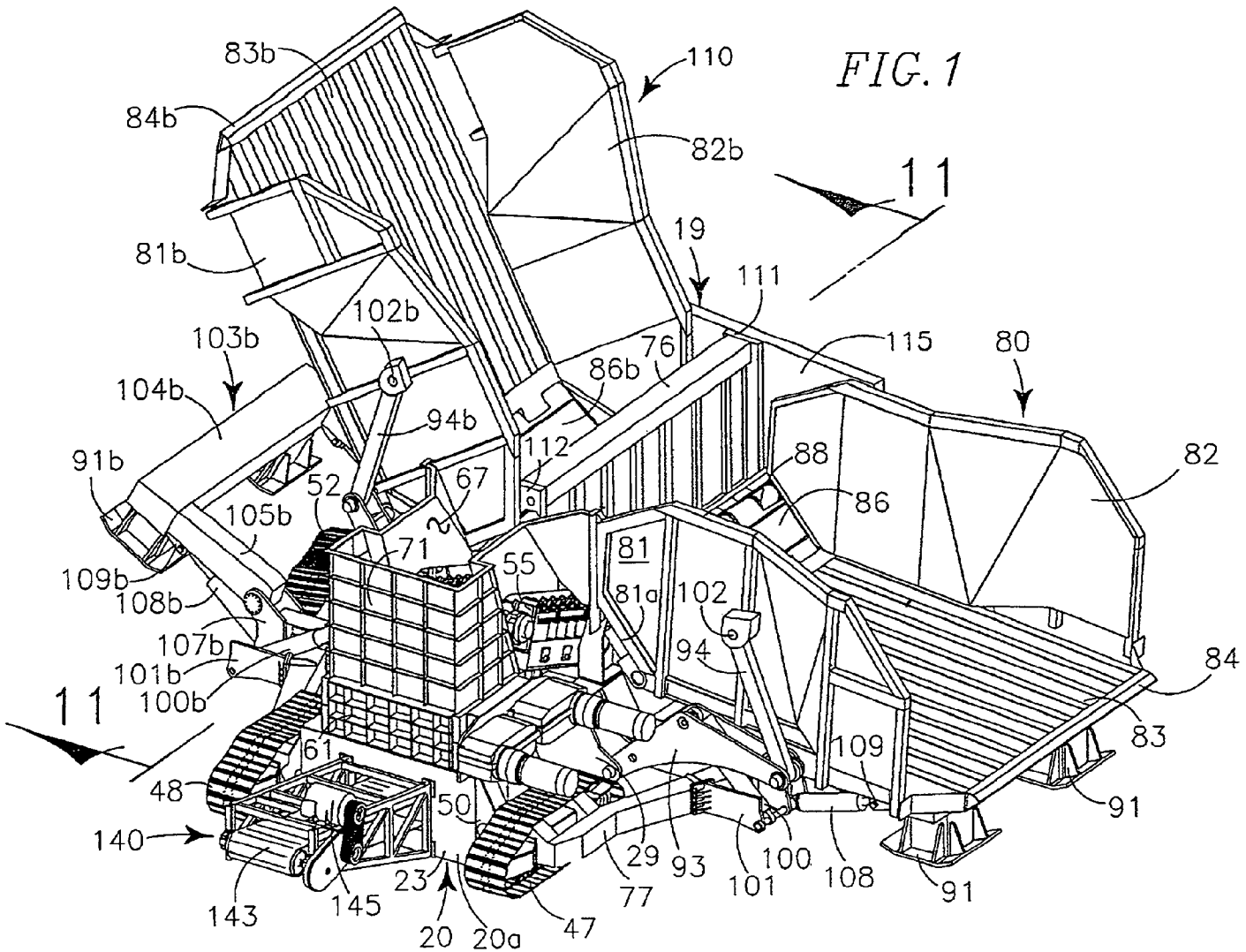
FIG. 1 is an isometric front, side and top view of a first present preferred embodiment of the mobile crushing station showing the right truck skip and outboard stability jacks in a raised position.

As used herein in reference to a discussion of the present preferred embodiment of the mobile crushing station 19 shown in FIGS. 1-11, the term "front", its derivatives, and grammatical equivalents refers to the portion of a mobile crushing station 19 that is proximate to discharge conveyor 140. The term "back", its derivatives, and grammatical equivalents refers to the portion of the mobile crushing station 19 that is distal from the discharge conveyor 140. The term "outer", its derivatives, and grammatical equivalents refers to a side portion of the mobile crushing station 19 as opposed to a laterally medial portion.

The term "dump truck" 160 is given its common definition and, without limitation, may generally be defined as a self-propelled wheeled vehicle having a load carrying bed that pivots, about a horizontal axis proximate one end portion, which responsively raises the opposing end portion to dump material from the load carrying bed under the force of gravity.

The term "cycle time" is defined as the length of time required for a dump truck 160 to be filled with excavated material, generally by an excavator proximate a mine face, to travel to a crushing station, dump the loaded material into the crushing station, and return to the location proximate the mine face to be loaded with more excavated material.

The mobile crushing station 19 generally provides a chassis 20 carrying an apron plate feeder 55, a sizer 61, a first pivoting truck skip 80, a second pivoting truck skip 110 and a discharge conveyor 140.

The chassis 20 is a generally rectilinear structure having a front frame member 23 at a forward end portion 20*a*, a spaced apart parallel rear frame member 24 at a rearward end portion 20*b*, a first side member 21 at a first elongate side portion 20*c* and a second spaced apart parallel side member 22 at a second elongate side portion 20*d*. The front and rear frame members 23, 24 are structurally interconnected to the first and second side members 25, 26 respectively at adjacent end portions.

First outrigger assembly 25 extends laterally outwardly from the first side member 21 and a mirror image opposing second outrigger assembly 35 extends laterally outwardly from second side member 22.

The first outrigger assembly 25 has a forward outrigger arm 26 and a spaced apart parallel rearward outrigger arm 27 that extend perpendicularly from the first side member 21. The rearward outrigger arm 27 is spacedly adjacent the rear frame member 24, while the forward outrigger arm 26 is at a generally medial position on first side member 21. Outrigger 28 is structurally connected to and extends between the forward outrigger arm 26 and the rearward outrigger arm 27 spaced apart outwardly from the first side member 21. Similarly, second outrigger assembly 35 has a forward outrigger arm 36 and a spaced apart parallel rearward outrigger arm 37 that extend perpendicularly from the second side member 22. The rearward outrigger arm 37 is spacedly adjacent the rear frame member 24, while the forward outrigger arm 36 is at a generally medial position on the second side member 22. Outrigger 38 is structurally connected to and extends between the forward outrigger aim 36 and the rearward outrigger arm 37 spaced apart outwardly from the second side member 22.

Four spacedly arrayed crawler track assemblies 47, 48, 51, 52 support the mobile crushing station 19 and provide for mobility and maneuverability for repositioning.

Figure 5:
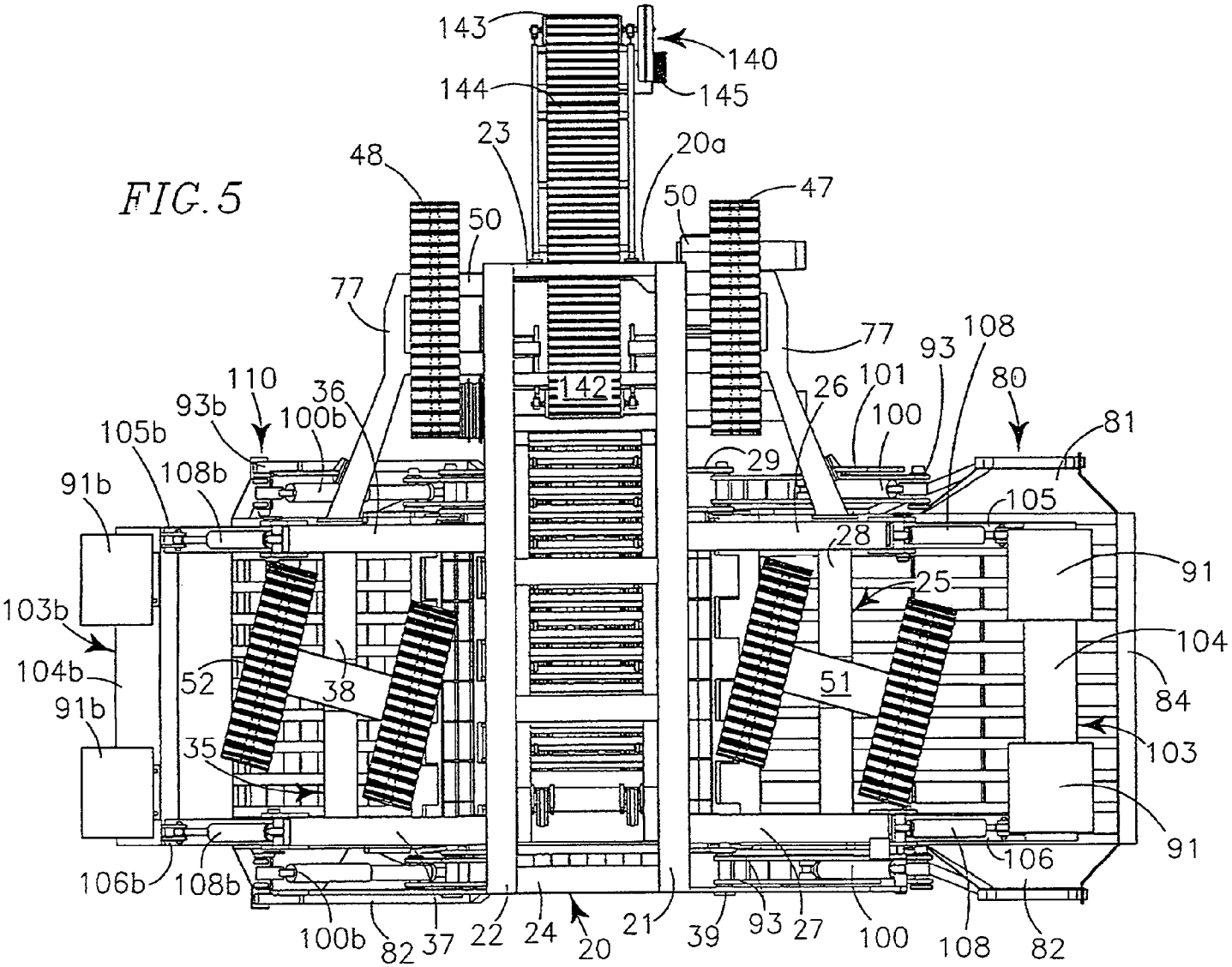
FIG. 5 is an orthographic bottom view of the first present preferred embodiment of the mobile crushing station showing the two car body type dual crawler track assemblies skewed in one direction for maneuvering.

As shown in FIG. 5, first fixed crawler 47 is carried spacedly adjacent the first side member 21 and a second fixed crawler 48 is carried spacedly adjacent the second side member 22 both proximate the front frame member 23 by fixed crawler mounting assembly 50. The first and second fixed crawlers 47, 48 each carry an endless track comprised of plural interconnected links that moves circuitously thereabout on a plurality of known rollers, sprockets and the like. Known motors, gears, rollers, sprockets and the like (not shown) power the endless tracks carried by the first and a second fixed crawlers 47, 48.

One car body type dual crawler track assembly 51, 52 is pivotally mounted to the outrigger 28 of the first outrigger assembly 25 and also to the outrigger 38 of the second outrigger assembly 35 at a generally medial position between the forward outrigger arms 26, 36 and the rearward outrigger arms 27, 37 respectively. The car body type dual crawler track assemblies 51, 52 are of known construction each having a pair of spaced apart parallel endless crawler track laying assemblies each carrying an endless track of interconnected links extending circumferentially thereabout. Known motors, gears, sprockets, rollers and the like (not shown) power the endless tracks on the track laying assemblies. Each car body type dual crawler track assembly 51, 52 is pivotal relative to the supporting outrigger 28, 38 about a kingpin assembly (not shown). Pivoting of the car body type dual crawler track assemblies 51, 52 is known as "skewing the tracks" which allows the mobile crushing station 19 to move, to maneuver and to steer.

In the preferred embodiment, a hydraulic steering ram (not shown) having one end portion pivotally interconnected to the car body type dual crawler track assembly 51, 52, and an opposing second end portion pivotally interconnected to the outrigger assembly 25, 35 pivot the car body type dual crawler track assemblies 51, 52 about the kingpins (not shown) responsive to inflow and outflow of pressurized fluid. In a second possible embodiment a known bull-wheel gear assembly may be used to pivot the car body type dual crawler track assemblies 51, 52 relative to the outriggers 28, 38.

The car body type dual crawler track assemblies 51, 52 support the majority of the weight of the mobile crushing station 19 and the spacing array between the dual crawler track assemblies 51, 52 and the first and second fixed crawlers 47, 48 forms a somewhat tricycle-like stature with plural spacedly arrayed ground engaging supports that enhance stability and distribute weight over a large area allowing smaller crawler track assemblies to be utilized, which further reduces overall height of the mobile crushing station 19.

In the preferred embodiment the mobile crushing station 19 is supported by and moves on four spacedly arrayed independently powered crawler assemblies 47, 48, 51, 52 two of which are pivotal on kingpin assemblies (not shown). However, it is envisioned that an alternative embodiment of the mobile crushing station 19 may also be supported by and move upon known powered walking beam structures. It is also envisioned that embodiments of the mobile crushing station 19 may be unpowered and moved from location to location on at least one un-powered crawler track assembly by being towed and/or pushed by earth moving equipment such as bulldozers.

Sizer 61, which may also known as a "rock crusher", is carried by the chassis 20 adjacent the front frame member 23 between the first and second side members 21, 22. The sizer 61 has a forward edge portion 63, a spaced apart rearward edge portion 64, a first side portion 65, and an opposing spaced apart second side portion 66 all interconnected at adjoining edge portions forming a rectilinear frame 62. The frame 62 defines an open top feed orifice 67 and an open bottom discharge orifice 68 and carries two parallel spacedly adjacent rock crushing drums 70 that rotate on drum axles (not shown) supported by opposing portions of the frame 62. Each rock crushing drum 70 carries on its circumferential surface a plurality of radially extending rock crushing teeth that intermesh with the rock crushing teeth carried by the adjacent rock crushing drum 70. Known drive motors (not shown) and gear assemblies (not shown) rotate the rock crushing drums 70 to comminute excavated material deposited therein.

In a preferred embodiment of the sizer 61 included in the mobile crushing station 19, the rock crushing drums 70 rotate in opposite directions so the adjacent circumferential surfaces move downwardly and the rock crushing teeth are arranged on the rock crushing drums 70 in a helical pattern so that material moves to one end portion of the frame 62. Excavated material deposited into the sizer feed orifice 67 by apron plate feed conveyor 55 is comminuted by tumbling, by rock-upon-rock impact and by shearing forces generated by the rock crushing drums 70 and the rock crushing teeth impacting the material. Amperage load sensors (not shown) are operatively interconnected to the drive motors and are configured to sense when the drive motors are being overloaded and responsively slow the rate at which material is fed into sizer 61 by reducing speed of the apron plate feed conveyor 55.

Figure 4:
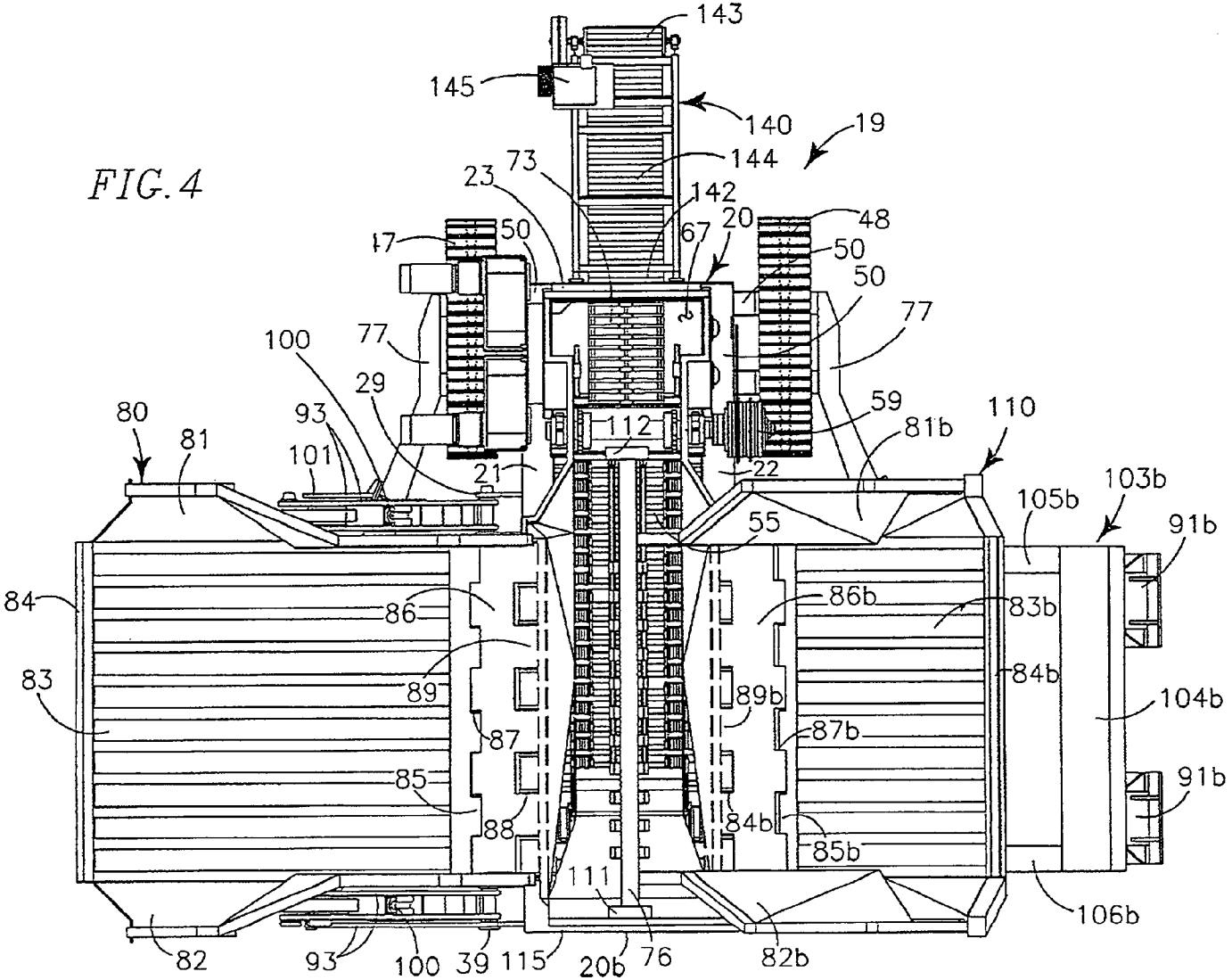
FIG. 4 is a plan view of the first present preferred embodiment of the mobile crushing station.

Feed hopper 71 proximate above and communicating with the sizer 61 functions as a funnel for material deposited therein by the apron plate feed conveyor 55. As shown in FIG. 4, grizzly 73, which is more formally known as a top size control aperture, which is a bar grating structure comprised of a plurality of spaced apart parallel bars that allow only a certain size of material to pass therethrough and therebetween, is carried within the feed hopper 71 spacedly above the open top feed orifice 67 and prevents rocks, boulders, pieces of excavated material, and the like, that are too large to be comminuted from entering the sizer 61.

Figure 11:
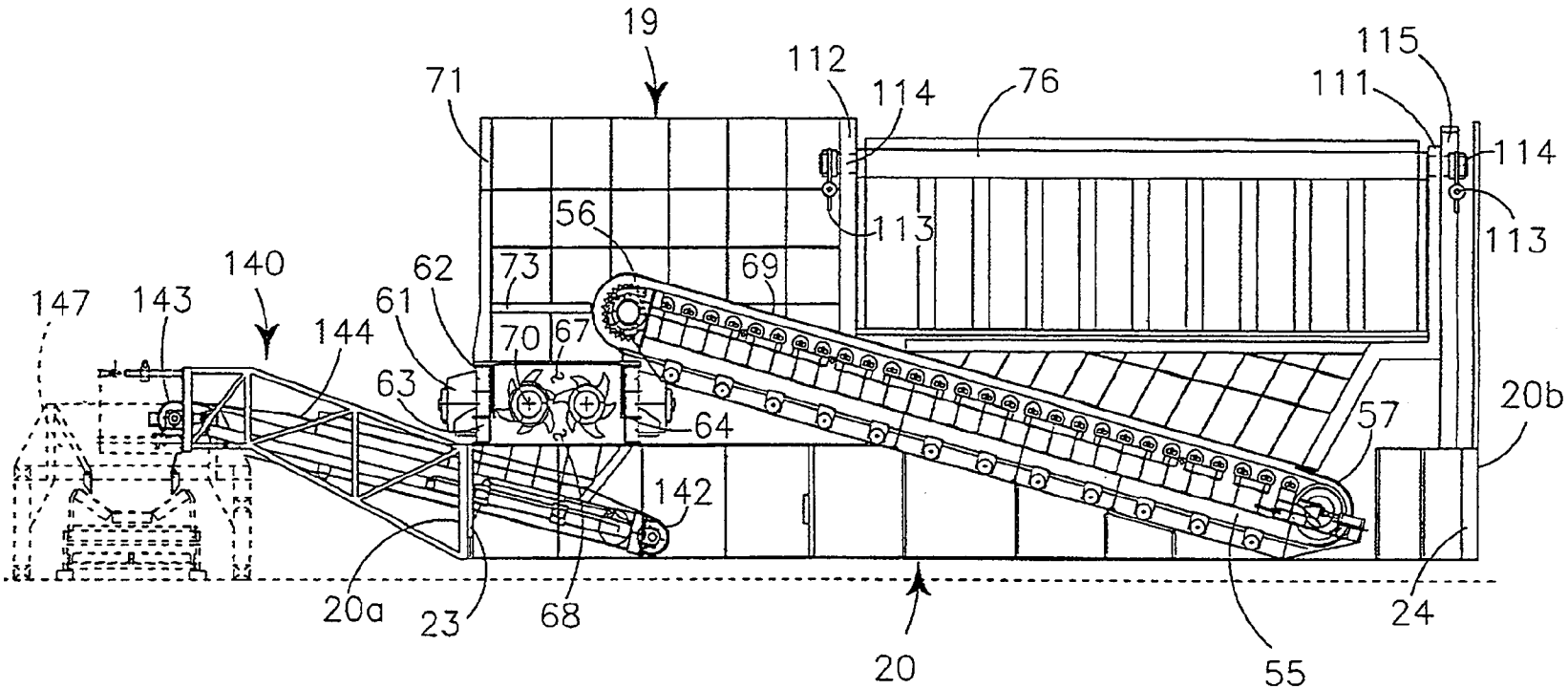
FIG. 11 is a partial cut away orthographic cross-section view of the first present preferred embodiment of the mobile crushing station taken on line 11-11 of FIG. 1, less the crawler assemblies and less the pivoting truck skips, showing the arrangement of the communicating components.
Figure 12:
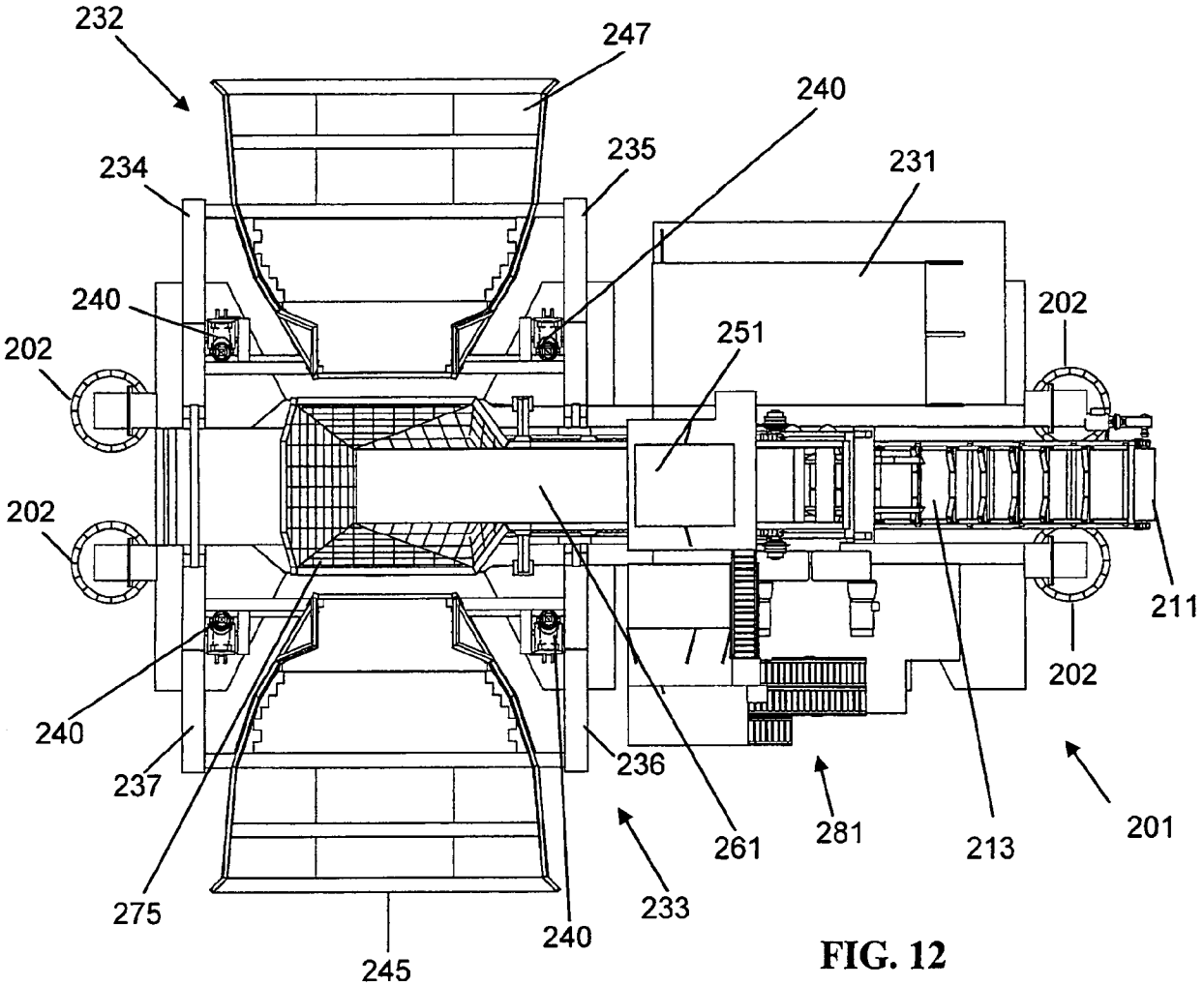
FIG. 12 is a top view of a second present preferred embodiment of a mobile crushing station.
Figure 13:
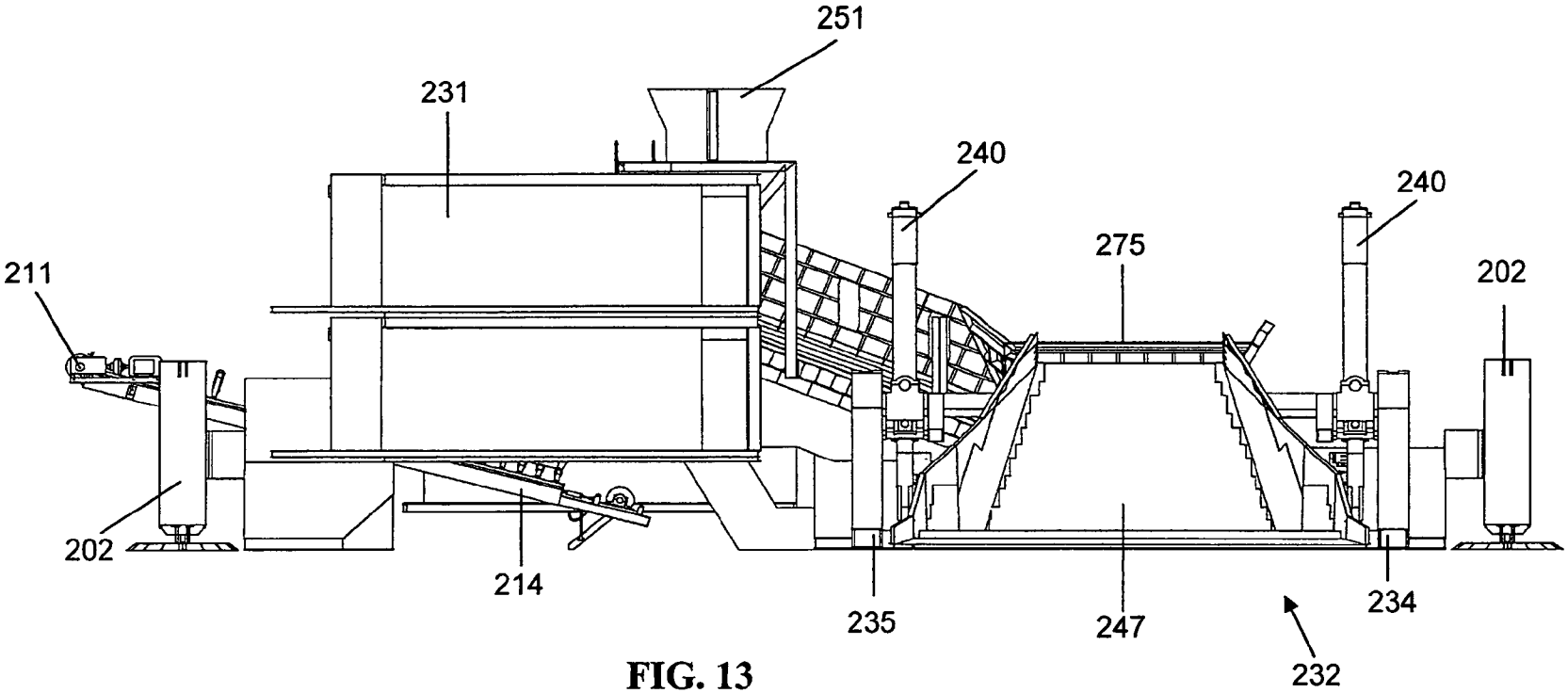
FIG. 13 is a side view of the second present preferred embodiment of the mobile crushing station.
Figure 14:
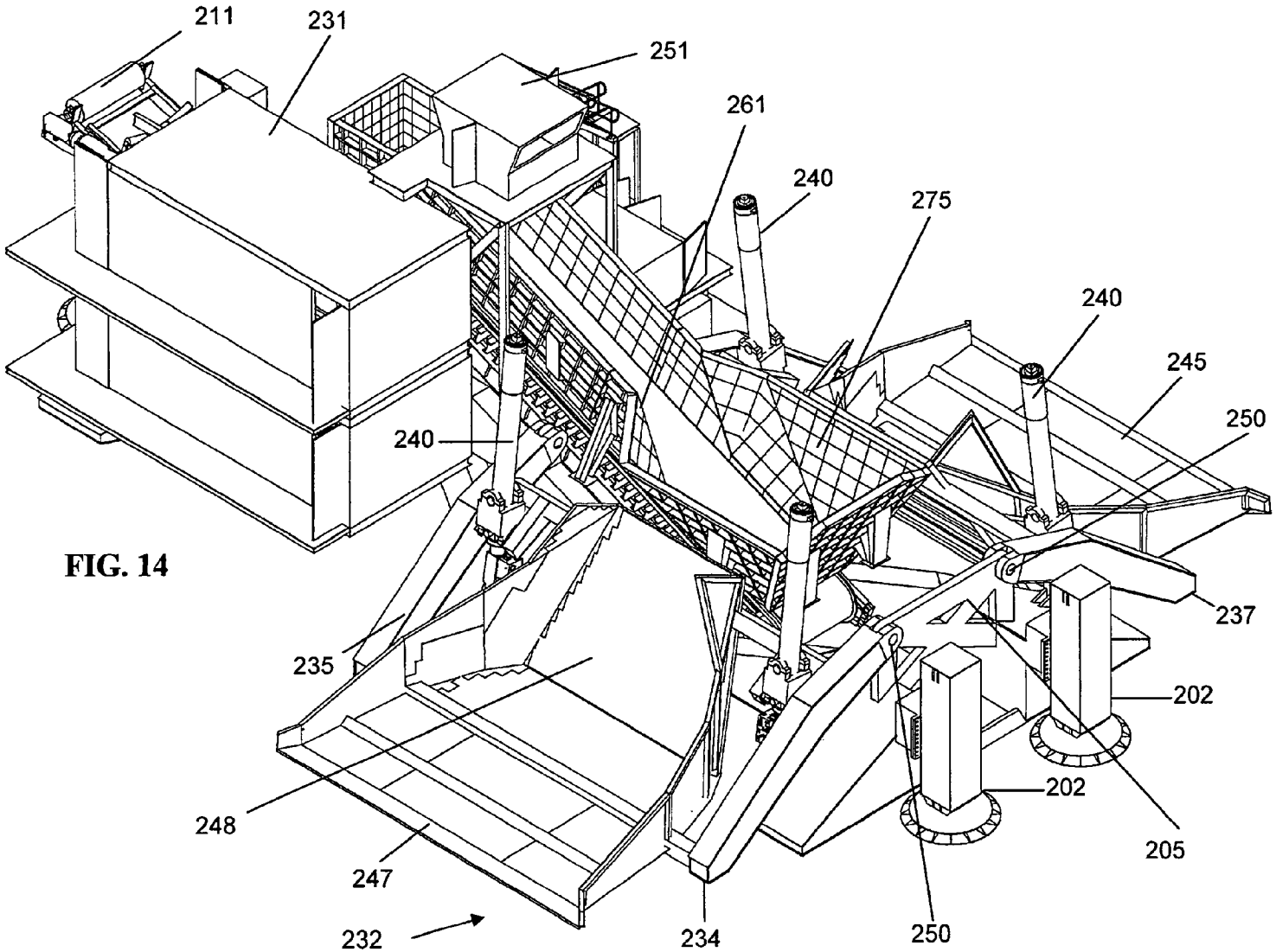
FIG. 14 is a perspective view of the second present preferred embodiment of the mobile crushing station.
Figure 15:
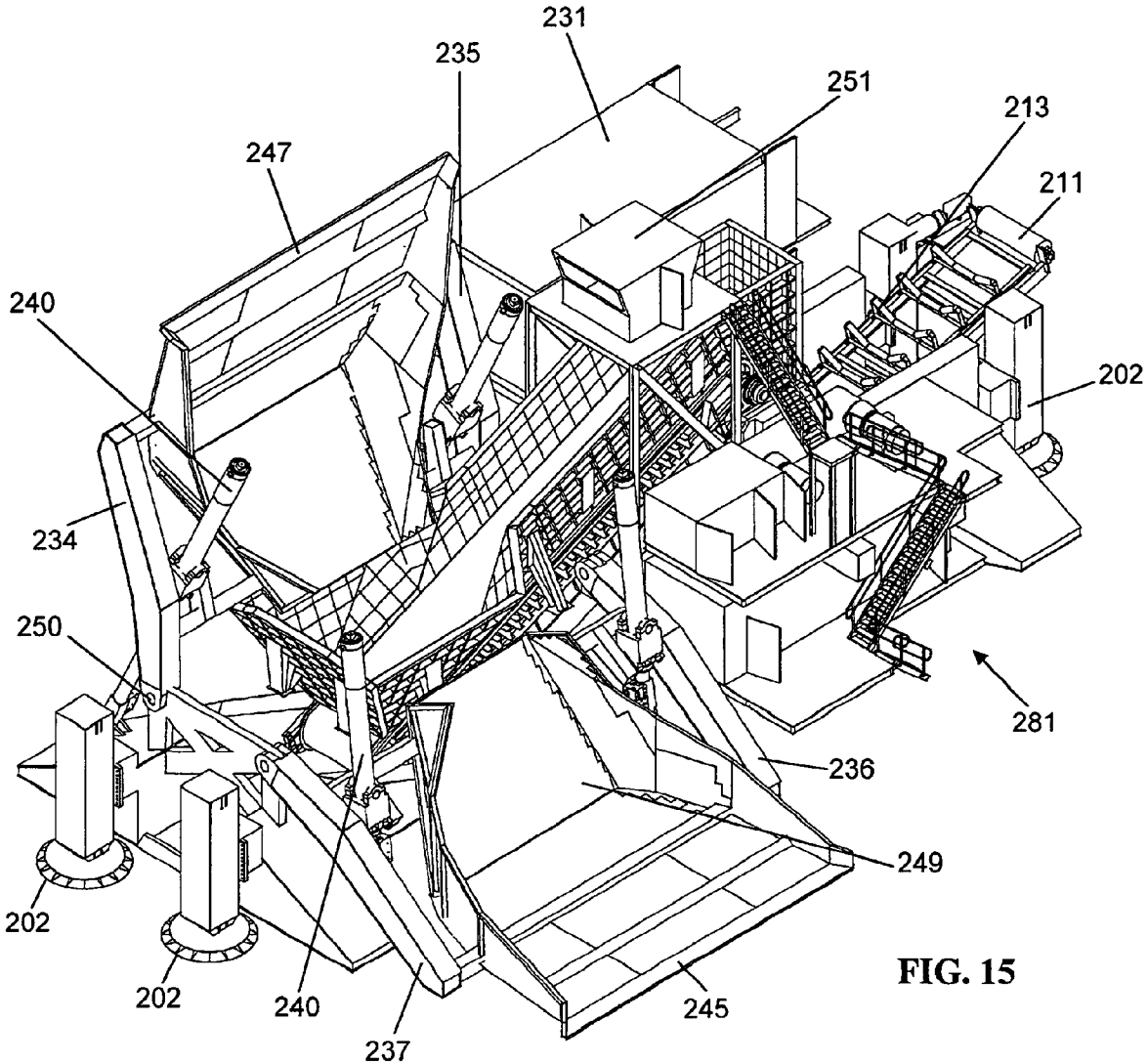
FIG. 15 is a perspective view of the second present preferred embodiment of the mobile crushing station with one of the skips positioned for dumping material into the hopper and onto the inclined feed conveyor.
Figure 16:
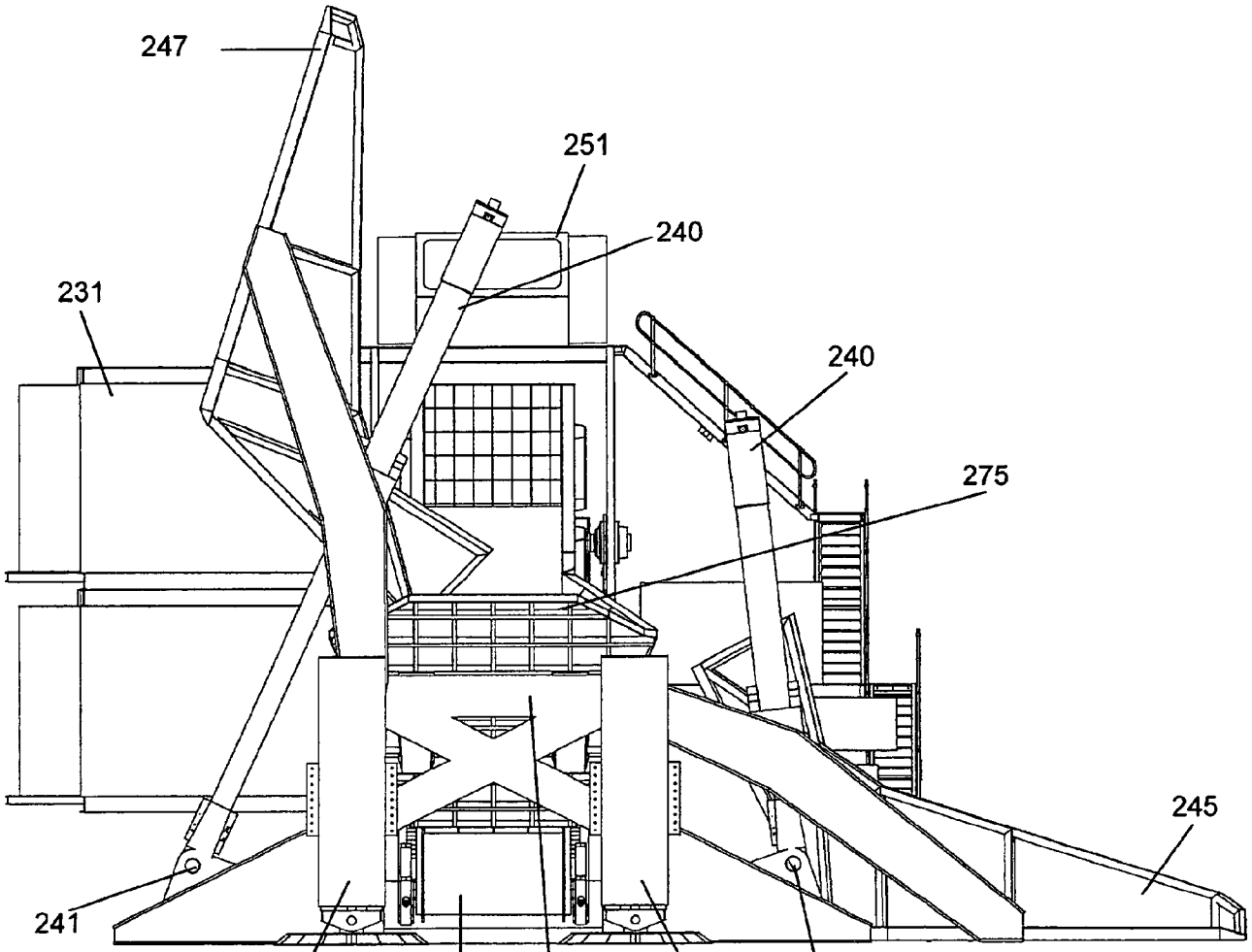
FIG. 16 is a side view of the second present preferred embodiment of the mobile crushing station with one of the skips positioned for dumping material into the hopper and onto the inclined feed conveyor.
Figure 17:
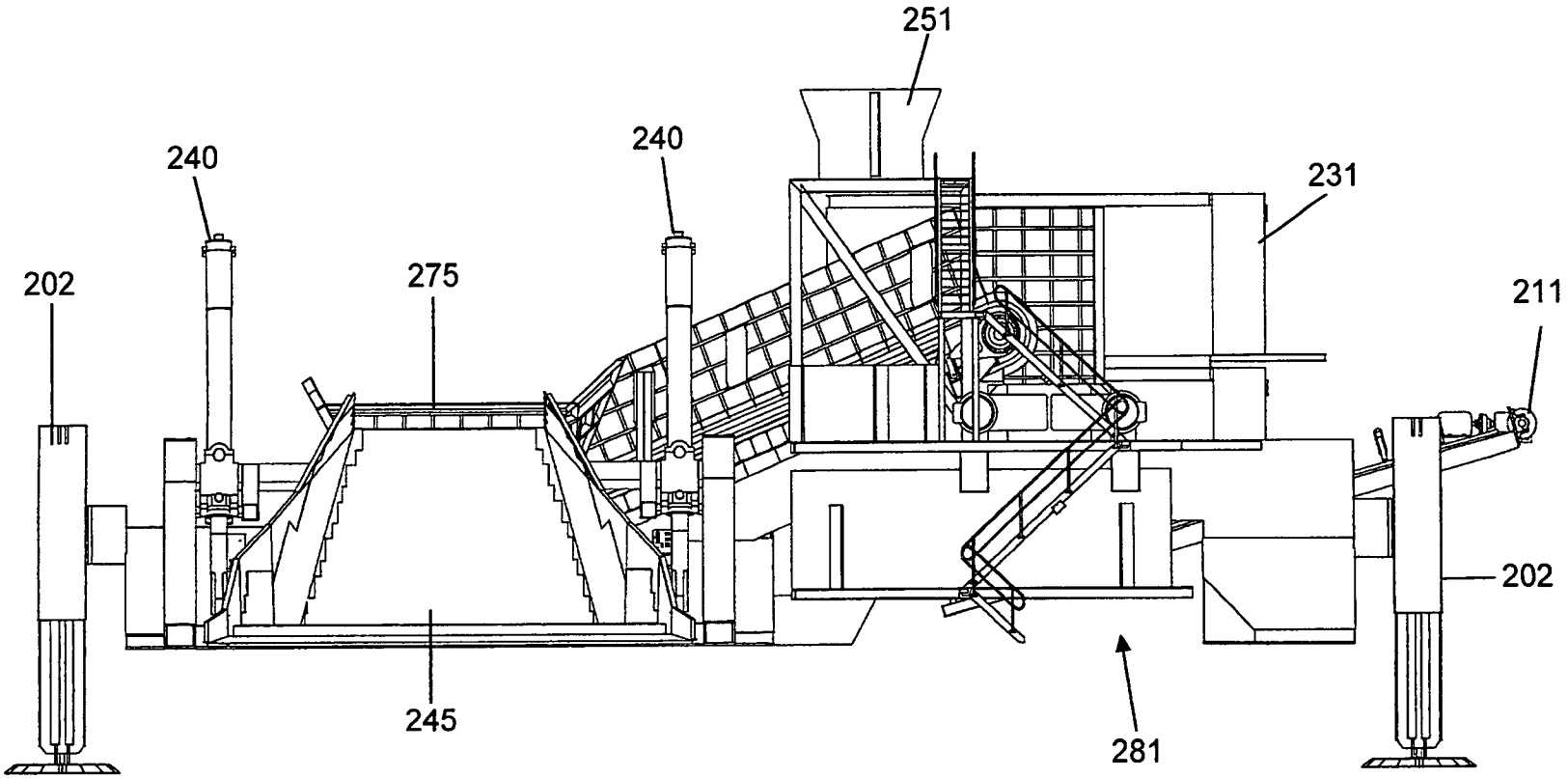
FIG. 17 is a side view of the second present preferred embodiment of the mobile crushing station with the jacks in an extended position, which can help facilitate a repositioning of the mobile crushing station.

As shown in FIG. 11, apron plate feed conveyor 55 carried by the chassis 20 between the first and second side members 23, 24 respectively, has a first end portion 56, an opposing second end portion 57 and carries an endless belt 69 that moves circuitously thereabout on a plurality of known rollers, guides and the like. Second end portion 57 of the apron plate feed conveyor 55 is proximate vertically extending rear wall 115 that prevents material from falling off the rearward end portion 20 of the chassis. First end portion 56 of the apron plate feed conveyor 55 communicates with feed hopper 71 and is positioned above the grizzly 73. Endless belt 69 is of known construction and is preferably comprised of a plurality of durable interconnected belt links and is powered by feed conveyor motor 59. First end portion 56 of apron plate feed conveyor 55 is vertically higher than second end portion 57 so that the center of gravity of the mobile crushing station 19 may be kept low and the required lift height of the pivoting truck skips 80, 110 is minimized.

Figures 6, 10:
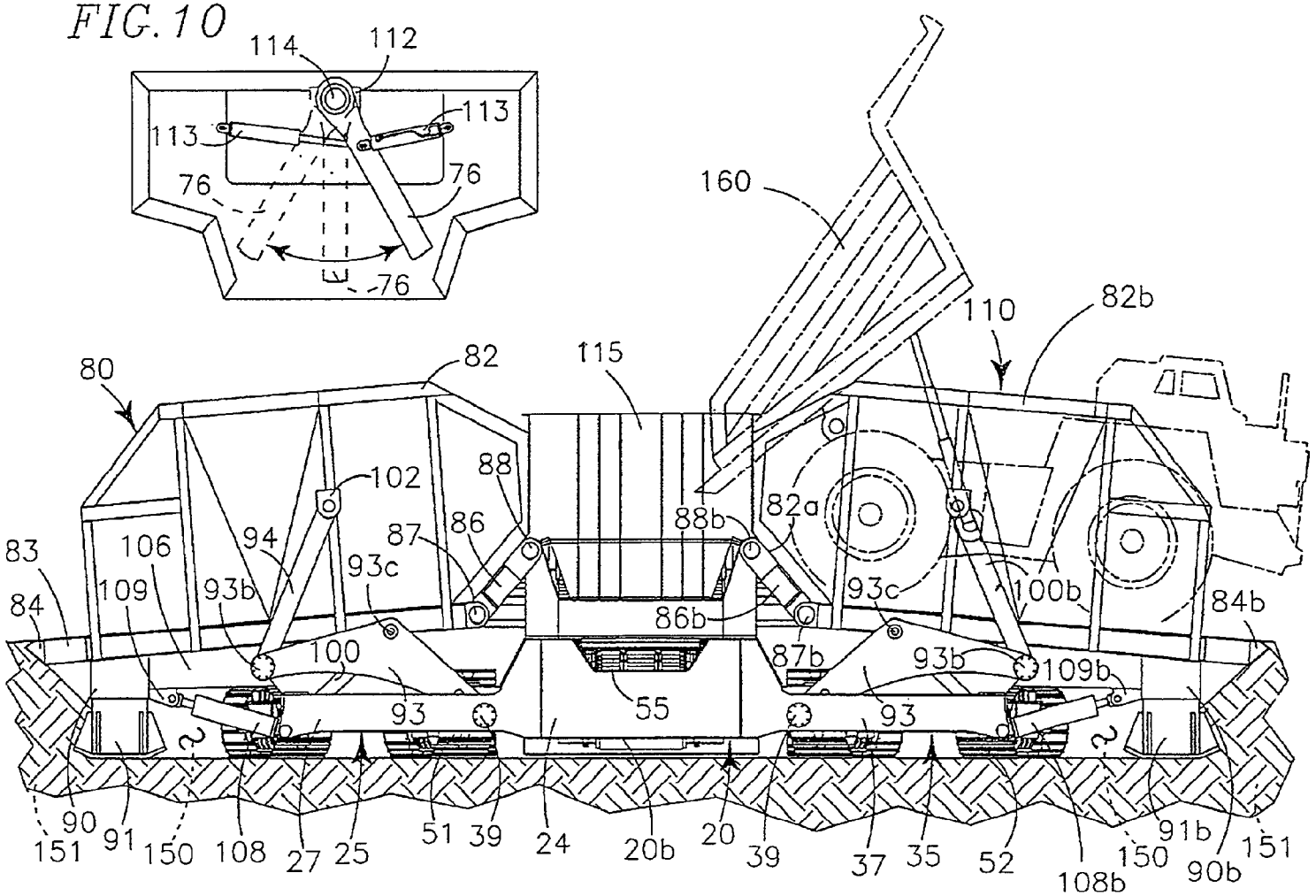
FIG. 6 is an orthographic back, forward-looking view of the first present preferred embodiment of the mobile crushing station operably positioned in a trench showing a dump truck, in phantom outline, backed into one pivoting truck skip.
FIG. 10 is an enlarged back, forward looking view of the diverter gate of the first present preferred embodiment pivoted to the second side which would be visible in FIG. 6 with the vertically extending rearward wall removed.

As shown in FIGS. 10 and 11, diverter gate 76 is an elongate rectilinear grate-like structure positioned spacedly adjacent above the apron plate feeder 55 that is movable about a pair of spaced apart horizontally aligned pivot axles 114 to regulate the rate at which excavated material within a pivoting truck skip 80, 110 moves onto the apron plate feed conveyor 55 and also to prevent material from spilling from one pivoting truck skip 80, 110 into the opposing pivoting truck skip 80, 110 when one of the pivoting truck skips 80, 110 is pivoted upwardly. Diverter gate pivot beam 111 has a lower end portion structurally interconnected to the chassis 20 proximate the rear frame member 24 and extends vertically upwardly therefrom. Diverter gate pivot frame 112 is carried by the chassis 20 between the first and second side members 21, 22 respectively proximate forward end portion of the diverter gate 76. The diverter gate 76 swings, relative to the pivot beam 111, the pivot frame 112 and apron plate feed conveyor 55 on two horizontally aligned pivot axles 114 carried at opposing end portions of the diverter gate 76 opposite the apron plate feed conveyor 55. The pivot axles 114 rotatably communicate with upper end portions of the pivot beam 111 and pivot frame 112 allowing the elongate edge portion of the diverter gate 76, proximate to the apron plate feeder 55, to swing in an arc. (FIG. 10). Known hydraulic cylinders 113 swing the diverter gate 76 between a first position proximate the second frame side member 22 which prevents material from spilling into the first pivoting truck skip 80, a second position medially between the first pivoting truck skip 80 and the second pivoting truck skip 110, and a third position proximate the first frame side member 21 which prevents material from spilling into the second pivoting truck skip 110. The position of the diverter gate 76 is controlled by an operator (not shown) to regulate the rate at which excavated material moves from the pivoting truck skip 80, 110 onto the apron plate feed conveyor 55.

In an alternative embodiment of the mobile crushing station, the diverter gate 76 may be replaced by an arcuate screen that defines a plurality of spacedly arrayed orifices and extends over the apron plate feed conveyor 55 between the opposing pivoting truck skips 80, 110 extending from the first end portion 56 to the second end portion 57. The arcuate screen operates similar to a known grizzly and regulates the feed rate of excavated material onto the apron plate feed conveyor 55.

One or more optional hydraulic rock breakers (not shown) can be carried proximate the open top of the feed hopper 71 and may be employed when the grizzly 73 becomes blocked, such as by a rock or piece of material that is too big to pass between the spaced apart bars, or to break a material bridge that cannot be disrupted.

Best shown in FIG. 5, a discharge conveyor 140 that has an endless conveyor belt 144 thereon, is carried at the forward end portion 20*a* of the chassis 20 and extends partially thereunder so that second end portion 142 of the discharge conveyor 140 is spacedly below open bottom discharge orifice 68 of the sizer 61 so that material comminuted within sizer 61 exits the open bottom discharge orifice 68 and is deposited on the second end portion 142 of the discharge conveyor 140. Endless belt 144 transports the comminuted material from the second end portion 142 to head-chute 143 which is the opposing end portion of the discharge conveyor 140 for transfer to another transport mechanism 147 such as another endless conveyor for transporting the comminuted material to a distal site, such as a storage pile, storage area, or other location.

First pivoting truck skip 80 is a "channel-like" structure having a planar vehicle floor 83, a structurally attached forward lateral wall 81 at a forward edge portion and a spaced apart structurally attached rearward lateral wall 82 at a rearward edge portion. The forward and rearward lateral walls 81, 82 have a plurality of structurally interconnected panel sections that extend generally vertically perpendicularly from the vehicle floor 83 and are configured so that the forward and rearward lateral walls 81, 82 flare outwardly to be more widely spaced from one another distal from the chassis 20. The outward flaring of the forward and rearward lateral walls 81, 82 makes backing a dump truck 160 into a truck skip 80, 110 easier for an operator and also functions as a "funnel of sorts" concentrating material deposited in the pivoting truck skip 80, 110 by a dump truck 160 into the apron plate feeder 55 proximate the diverter gate 76.

Ramp edge 84 of vehicle floor 84 is beveled, or may be bull-nosed, to ease passage of dump truck wheels thereover when a dump truck 160 backs into one of the pivoting truck skips 80, 110.

Hinged floor 86 is generally planar and is pivotally interconnected to hinge edge 85 of the vehicle floor 83 along adjacent edge portion by floor hinge 87 which is preferably a large diameter pin hinge that allows pivotal movement between the hinged floor 86 and the vehicle floor 83. Opposing edge portion 89 of the hinged floor 86, opposite the vehicle floor 83, is pivotally interconnected to the first frame side member 21 proximate the apron plate feeder 55 by skip hinge 88 that is preferably a large diameter pin hinge that allows pivotal movement between the hinged floor 86 and the first frame side member 21.

Figure 8:
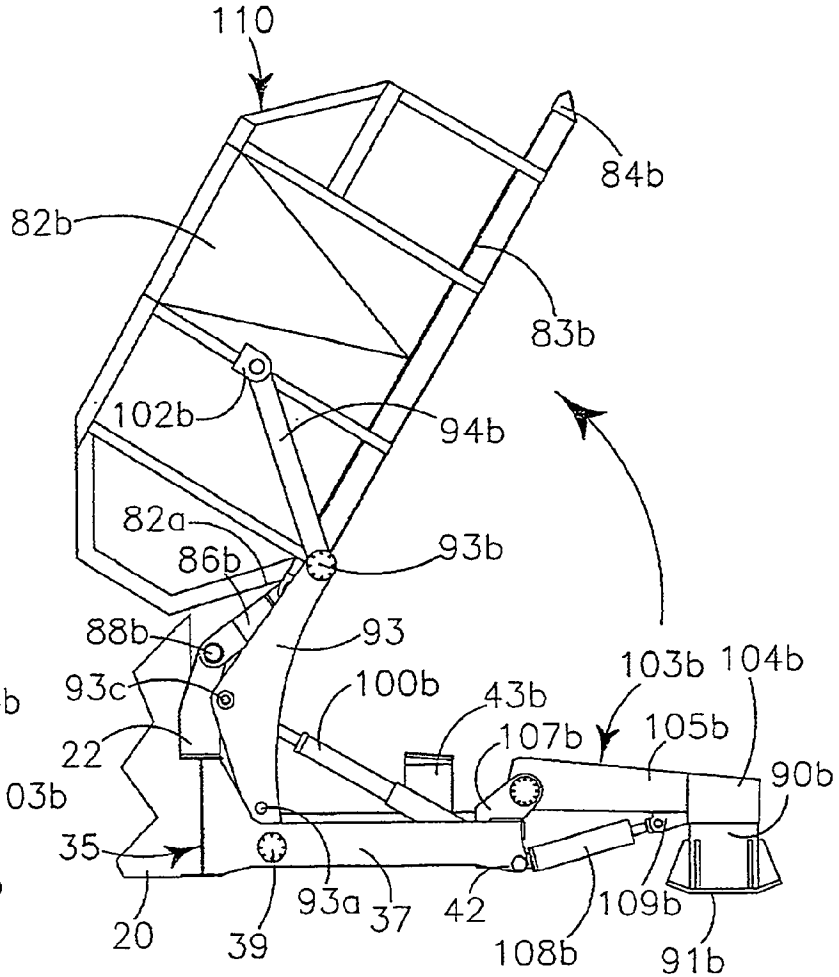
FIG. 8 is a partial cut away view, similar to that of FIG. 7, showing the pivoting truck skip in an elevated position and showing the hinged floor and vehicle floor in a more linear alignment.
Figure 7:
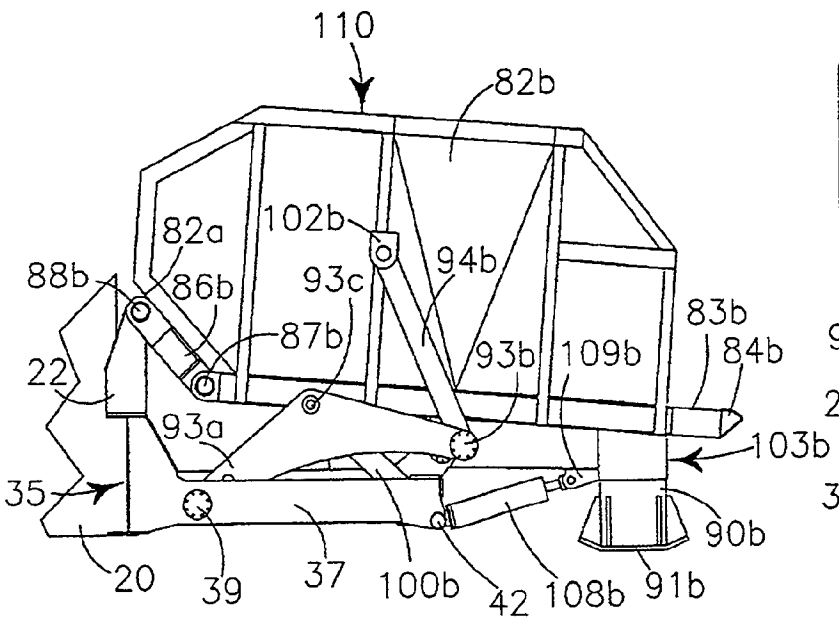
FIG. 7 is a partial cut away view of one pivoting truck skip of the first present preferred embodiment in a lowered position showing the wheel stop angulation between the vehicle floor and the hinged floor.

As shown in FIGS. 4, 7 and 8, hinged floor 86*b* and the spaced apart pivotal parallel floor hinge 87*b* and skip hinge 88*b* allow the vehicle floor 83*b* to maintain a substantially horizontal orientation when the truck skip 80, 110 is in its lowered position (FIG. 7) because the hinged floor 86*b* is more angular thereto. When the pivoting truck skip 80, 110 is pivoted upwardly, (FIG. 8) the vehicle floor 83*b* and the hinged floor 86*b* move to a more linear alignment so that excavated material deposited within the pivoting truck skip 80, 110 by a dump truck 160, or otherwise, may slide along and across the vehicle floor 83*b* and hinged floor 86*b* onto the apron plate feed conveyor 55. Lower laterally inner edge portions of the forward and rearward lateral walls 81, 82 proximate the chassis 20 are configured with an angular edge 81*a*, 82*a* to accommodate the steeper angulation of the hinged floor 86 to prevent material deposited in a skip 80, 110 from passing thereunder and therebetween.

Bell crank 93, which is a double bell crank structure having two substantially identical spaced apart parallel portions, each having a first inner end portion 93*a*, an opposing second outer end portion 93*b* and a medial portion 93*c* pivotally communicates between chassis 20 and pivoting truck skip 80, 110 and provides mechanical leverage to pivot the pivoting truck skip 80, 110 upwardly. First inner end portion 93*a* of forward bell crank 93 pivotally interconnects with chassis bell crank pivot 29, which is structurally interconnected with the chassis 20. Medial portion 93*c* pivotally interconnects with one end portion of hydraulic lifting cylinder 100 which also communicates at an opposing second end portion with forward skip lift cylinder bracket 101 carried by angular tie beam 77 communicating between forward outrigger arm 26 and proximate fixed crawler mounting assembly 50.

Second end portion 93*b* of bell crank 93 pivotally carries lower end portion of elongate hoisting arm 94 which pivotally communicates, at opposing upper end portion, with hoist arm pivot 102 structurally carried by the pivoting truck skip 80, 110 adjacent the forward and rearward lateral wall 81, 82. Expansion and contraction of the hydraulic lifting cylinder 100 rotates bell crank 93 relative to the chassis bell crank pivot 29 and responsively raises the second end portion 93*b* of the bell crank 93. The elongate hoisting arm 94, and its pivotal interconnection with the hoist arm pivot 102 which is more proximate the floor hinge 87 than the ramp edge 84, accentuates the motion of the bell crank 93 and increases the amount throw provided by the hydraulic lifting cylinder 100 effectively raising the pivoting truck skip 80, 110 to an elevated angular position whereat the vehicle floor 83 and hinged floor 86 are more linearly aligned and material contained within the pivoting truck skip 80 slides, under the force of gravity, along and across the vehicle floor 83, across the hinged floor 86 and onto the apron plate feeder 55. Each of the pivoting truck skips 80, 110 pivots to an angle of between approximately 45° and 75° above horizontal, and preferably pivots to an angle of 51° above horizontal. The angle of pivot above horizontal is sufficient to overcome friction and cause the excavated material on the vehicle floor 83 and the hinged floor 86 to slide, under the force of gravity, toward and onto the apron plate feed conveyor 55.

A similar lifting assembly comprising a similar pair of bell cranks 93, hydraulic lifting cylinder 100 and hoisting arm 94 is carried adjacent the rearward end portion 20*b* of the chassis 20 and the rearward lateral wall 82 so that two pairs of bell cranks 93, a pair of hydraulic lifting cylinders 100 and a pair of hoisting arms 92 operate in unison to lift the pivoting truck skip 80, 110. First inner end portion 93*a* of bell cranks 93 proximate the rearward end portion 20*b* of the chassis 20 pivotally interconnect with pivot axle 39 carried by proximate rearward outrigger arm 27, 37 spacedly adjacent the frame side member 21, 22.

Stability jack assembly 103 pivots relative to the supporting outrigger assembly 25, 35 and comprises a jack beam 104 parallel to and spaced apart from outrigger 28, 38 a forward jack beam leg 105, structurally attached to forward end portion of jack beam 104 and a rearward jack beam leg 106 structurally attached to rearward end portion of the jack beam 104. Each jack beam leg 105, 106 pivotally interconnects with a stability jack pivot bracket 107 structurally carried by the forward outrigger arm 26, 36 and the rearward outrigger arm 27, 37 opposite the chassis 20 so that the stability jack assembly 103 may be pivoted relative to the supporting outrigger assembly 25, 35.

Figure 2:
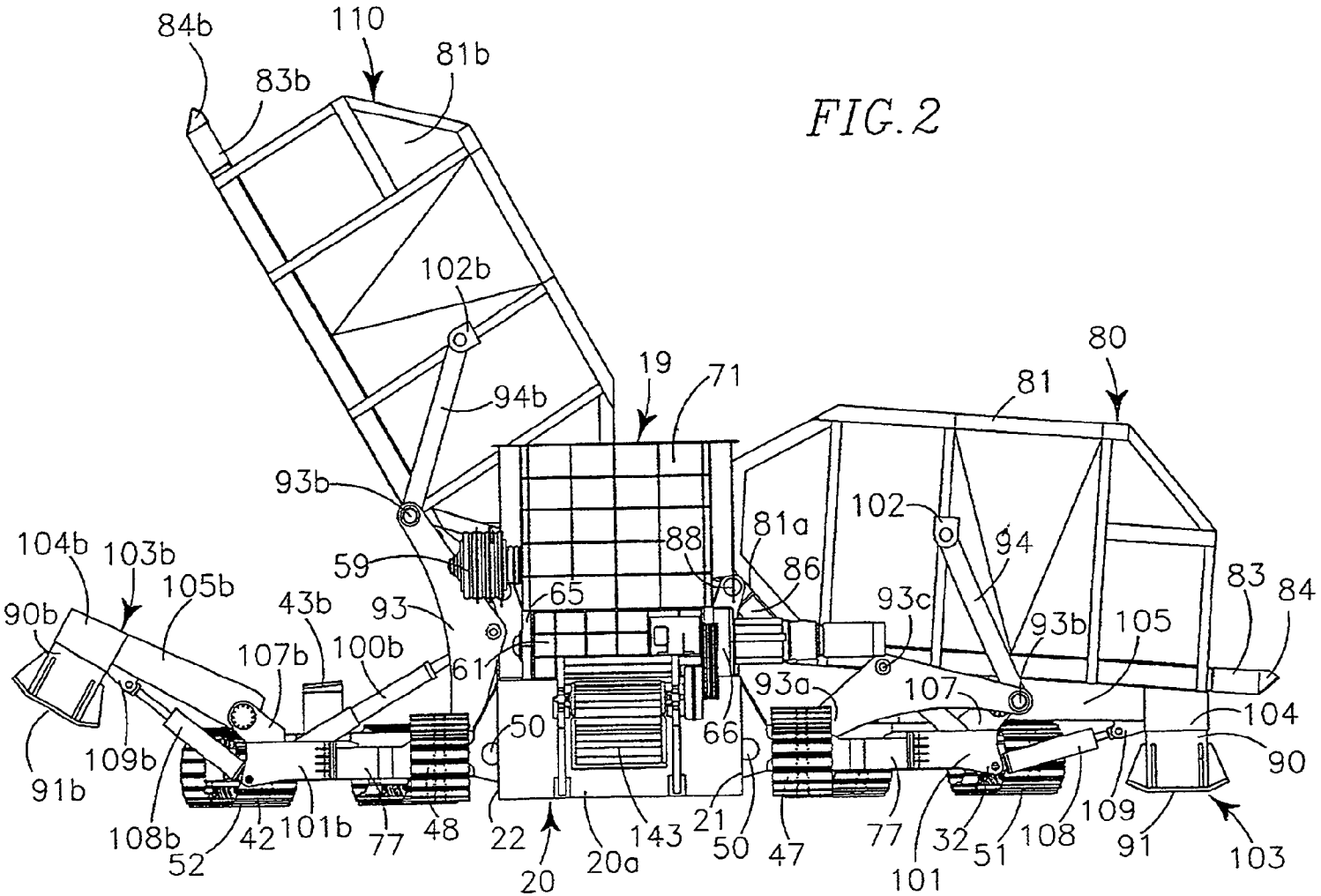
FIG. 2 is an orthographic front, rearward looking view, of the first present preferred embodiment of the mobile crushing station showing the right truck skip and outboard stability jacks in a raised position and the two car-body type dual crawler track assemblies skewed for maneuvering.
Figure 3:
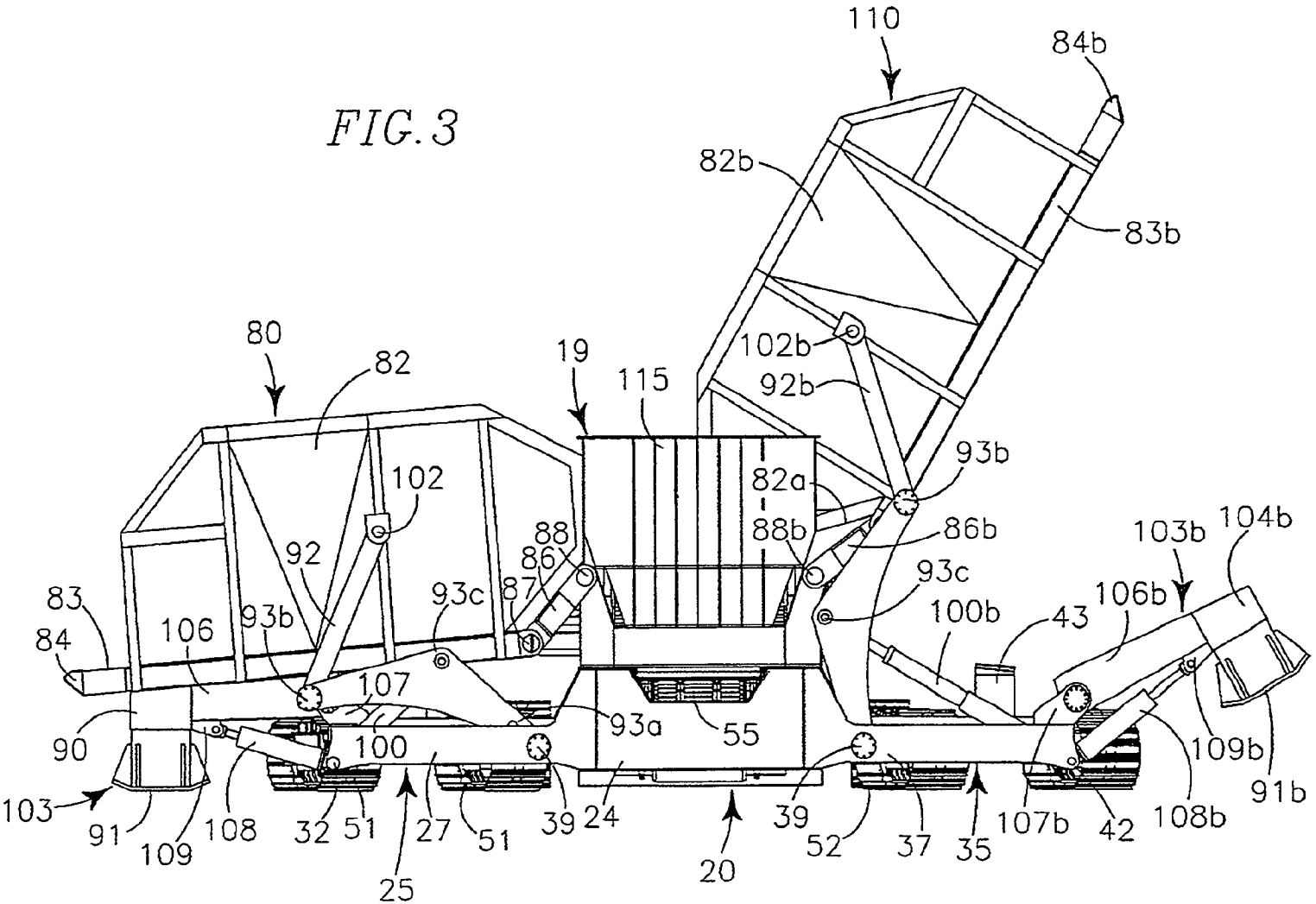
FIG. 3 is an orthographic back, forward-looking view, of the first present preferred embodiment of the mobile crushing station similar to that of FIG. 2.

Stability jack hydraulic cylinders 108 each have a first end portion interconnected with cylinder pivot flange 32, 42 at laterally outer end portion of outrigger arm 26, 36, 27, 37 and an opposing second end portion pivotally interconnected to jack beam cylinder yoke 109 spacedly adjacent inward stability jack foot 91. As shown in FIGS. 2 and 3 the stability jack assembly 103 may be raised and lowered responsive to expansion and contraction of the stability jack hydraulic cylinders 108 resulting from inflow and outflow of pressurized fluid to the stability jack hydraulic cylinder 108. Lowering the stability jack assemblies 103 so that the stability jack feet 91 rest upon the supporting ground surface (FIG. 6) enhances stability of the mobile crushing station 19. Raising the stability jack assemblies 103 at the same time (FIG. 9) allows movement for repositioning and relocation and enhances maneuverability.

As shown in FIG. 6 bottom portion of the vehicle floor 83 proximate the ramp edge 84 rests directly upon upper edge portion of the stability jack assembly 103 when the pivoting truck skip 80, 110 is in its lowered position. Direct frictional engagement between bottom portion of the vehicle floor 83 and upper surfaces of the stability jack assembly 103 provides additional support and strength for the pivoting vehicle skip 80, 110 to carry the massive loads exerted thereon when a loaded dump truck 160 backs into the pivoting truck skip 80, 110.

The second pivoting truck skip 110 is a minor image of the first pivoting truck skip 80 and second stability jack assembly 103*b* is a mirror image of the first stability jack assembly 103. For purposes of simplicity and brevity the descriptions of the second pivoting truck skip 110 and second stability jack assembly 103*b* have been eliminated as they are the same as the description of the first pivoting truck skip 80 and first stability jack assembly 103. The elements of the second pivoting truck skip 110 and second stability jack assembly 103*b* have been given, on the Figures, the same numbers as the elements of the first pivoting truck skip 80, and first stability jack assembly 103 but have been given a "b" for identification.

Having described the structure of the mobile crushing station 19, its operation may be understood.

After an ore deposit has been identified as economically viable, earth moving equipment is used to initiate the excavation which may involve removing sufficient topsoil and overburden material so that an angulated earthen ramp communicates from the surface level, down to a subsurface level where the ore is accessible.

The mobile crushing station 19, and related conveyor equipment is likely to be transported to the mine site in pieces and assembled on site. It should be understood that multiple mobile crushing stations 19 may operate in unison in the mining of a mineral/ore deposit.

Figure 9:
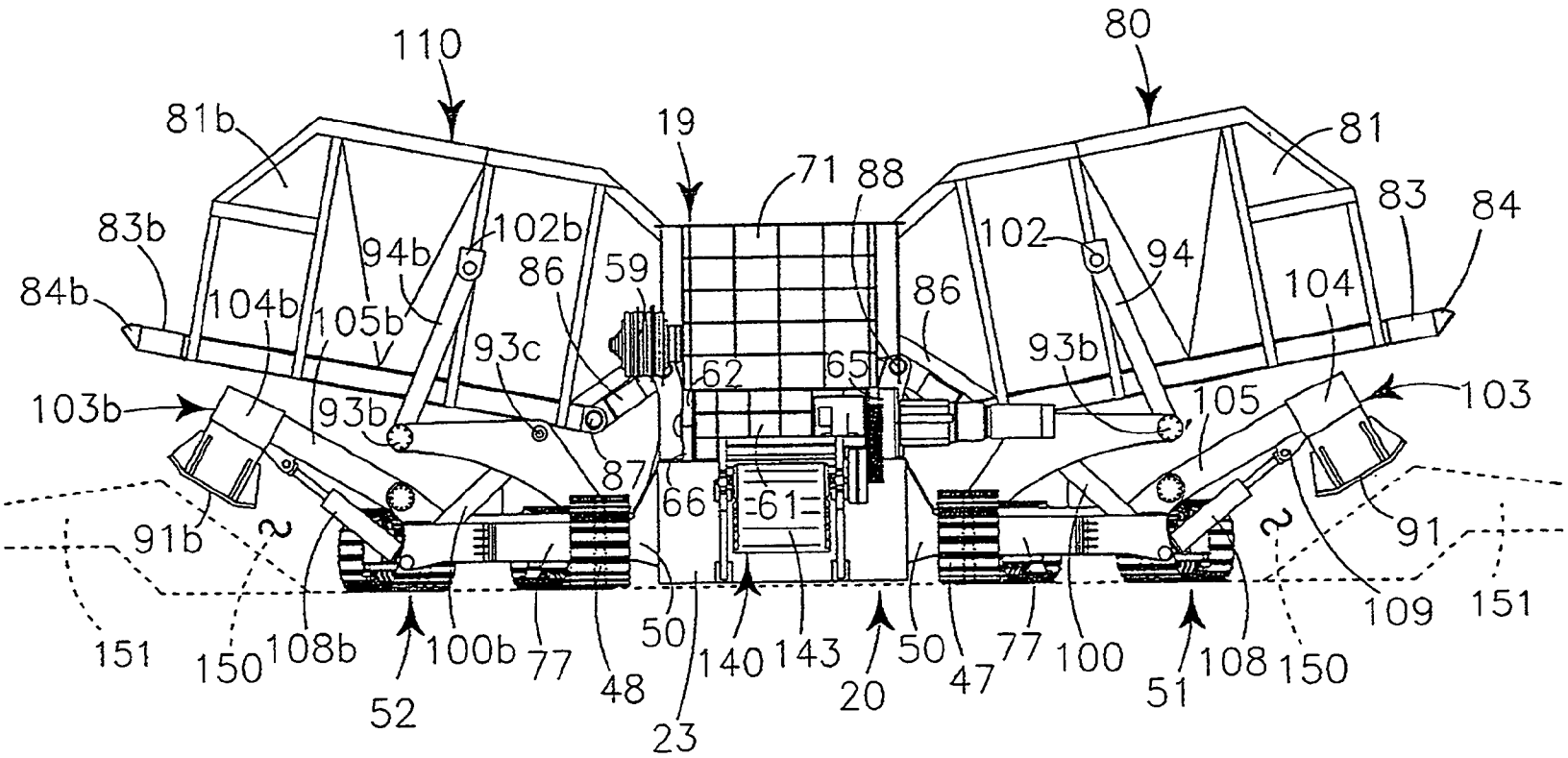
FIG. 9 is a reduced in size orthographic front, rearward looking view of the first present preferred embodiment of the mobile crushing station maneuvering in a trench with the stability jacks and pivoting truck skips pivoted upwardly.

As shown in FIG. 6 the mobile crushing station 19 is positionable in a trench 150 that has been dug into the supporting ground surface. Material excavated from digging the trench 150 is piled on both sides of the trench 150. The mobile crushing station 19 is driven, under its own power down an angulated ramp extending from the ground surface to the generally horizontal bottom portion of the trench 150 by operator actuation of the crawler assemblies 47, 48, 51, 52. (FIG. 9). In an alternative non-powered embodiment, the mobile crushing station 19 may be pushed and/or pulled into the bottom portion of the trench 150 by earth moving equipment such as bulldozers and the like. In a third possible embodiment the walking beam mechanism is activated and the mobile crushing station 19 moves into the bottom portion of the trench 150 under its own power.

Once positioned in the bottom of the trench 150, the stability jack assemblies 103, 103*b* are lowered by actuating a hydraulic pump system (not shown) that causes the stability jack hydraulic cylinders 108 to lower the stability jack assemblies 103, 103*b* until the stability jack feet 91 rest upon the ground surface inside the trench 150 proximate to a lateral wall of the trench 150. The pivoting truck skips 80, 110 are then pivoted downwardly by activating the hydraulic lifting cylinders 100, 100*b* which rotate the bell cranks 93 about bell crank pivots 29, 39. When lowered, the bottom portions of the vehicle floors 83, 83*b* rest upon the upper portions of the stability jack beams 104, 104*b*, and the hinged floors 86, 86*b* of the pivoting truck skips 80, 110 are more steeply angled, relative to horizontal, than the vehicle floors 83, 83*b* which allows the hinged floors 86, 86*b* to act as "wheel stops" for the rear wheels of dump trucks 160 backing into the pivoting truck skips 80, 110.

Earth moving equipment, such as a bulldozer, is used to manipulate the excavated trench material piled adjacent the trench 150 into short low rise ramps 151 communicating from the supporting ground surface to the ramp edge 84, 84*b* of the vehicle floors 83, 83*b* so that dump trucks 160 and the like may back into the pivoting truck skips 80, 110 and over the ramp edge portion 84, 84*b* of the vehicle floors 83, 83*b* with ease. Other access and exit roads may also be constructed as necessary for efficient dump truck 160 access to the pivoting truck skips 80, 110 and exit from the pivoting truck skips 80, 110.

Once positioned in the trench 150 and the stability jack assemblies 103, 103*b* have been lowered and the access ramps 151 constructed, a dump truck 160, or two dump trucks 160 at the same time back into the pivoting truck skips 80, 110 onto and across the vehicle floor 83, 83*b* between the forward and rearward lateral walls 81, 82, 81*b*, 82*b* respectively until the rear wheels of the dump truck 160 contact the upwardly angled hinged floor portion 86, 86*b*. The dump truck 160 deposits the material being carried in its load carrying bed onto the hinged floor 86, 86*b* and proximate portion of the vehicle floor 83, 83*b*. The dump truck 160 may pull forwardly as the material is dumped from the load carrying bed so that the entire load of material is deposited within the pivoting truck skip 80, 110. The forward and rearward lateral walls 81, 81*b*, 82, 82*b* retain the material on the vehicle floor 83, 83*b* and hinged floor 86, 86*b*. The diverter gate 76 which is positioned spacedly adjacent above the apron plate feeder 55 prevents material deposited in one pivoting truck skip 80, 110 from falling into the opposing pivoting truck skip 80, 110.

Load cells (not shown) under the pivoting truck skips 80, 110 weigh the material deposited in the pivoting truck skips 80, 110 by the dump trucks 160 and automatically compile data for recording production levels. The diverter gate 76, by preventing material from falling into the opposing pivoting truck skip 80, 110 insures accuracy of production measurements.

Operator (not shown) uses control system (not shown) to actuate hydraulic pumps (not shown) which communicate with the hydraulic lifting cylinders 100, 100*b* by means of high pressure hoses and fittings (not shown). High pressure fluid entering the hydraulic lifting cylinders 100, 100*b* causes the hydraulic lift cylinders 100, 100*b* to expand and responsively pivot the bell cranks 93 and elongate hoisting arms 94, 94*b* causing the vehicle floor 83, 83*b* and hinged floor 86, 86*b* to pivot upwardly and simultaneously become more linearly aligned. The upward pivoting of the truck skips 80, 110, the vehicle floor 83, 83*b* and hinged floor 86, 86*b* cause the material deposited in the pivoting truck skip 80, 110 to slide, under the force of gravity, along and across the floors 83, 83*b*, 86, 86*b* and onto the apron plate feeder 55.

Material on the apron plate feeder 55 is transported from a position proximate the upwardly pivoted truck skip 80, 110 and hinged floor 86, 86*b* to the feed hopper 71 and grizzly 73. Material falls off the first forward end portion 56 of the apron plate feeder 55 and into the feed hopper 71. The material passes through the spaced apart bars of the grizzly 73 and into the open top feed orifice 67 of the sizer 61. The material passes into the sizer 61 and passes between the two slow speed opposing rock crushing drums 70 and crushing teeth carried thereon where the material is comminuted by crushing forces, rock upon rock impacts and tumbling, into smaller more uniformly sized pieces. The comminuted material exits the sizer 61 through open bottom discharge orifice 68 and falls onto the second end portion 142 of the discharge conveyor 140 spacedly adjacent below the open bottom discharge orifice 68 of the sizer 61.

The material is transported along the endless belt 144 of the discharge conveyor 140 to the head chute 143 where the material is passed to another conveying mechanism 147 such as another conveyor system for transport to a distal site.

The first pivoting truck skip 80 and the second pivoting truck skip 110 may operate in unison or independently of one another. The diverter gate 76 is positioned as desired by the operator between the first and second pivoting truck skips 80, 110 above the apron plate feeder 55 to direct material from the pivoting truck skip 80, 110 onto the apron plate feeder 55. When both pivoting truck skips 80, 110 are being pivoted upward to empty material therein simultaneously, the diverter gate 76 is preferably be positioned medially between the pivoting truck skips 80, 110 so that material from both upwardly pivoted truck skips 80, 110 can access the apron plate feeder 55 simultaneously. When the pivoting truck skips 80, 110 are being operated one at a time, the operator will position the diverter gate 76 as desired to ensure the material within the pivoting truck skips 80, 110 is directed onto the apron plate feeder 55. (FIG. 10).

As the excavation continues, the mine face advances forwardly. Over time the distance between the mine face and the mobile crushing station 19 increases so that the dump trucks 160 must traverse too great a distance between the mine face, and the mobile crushing station to be economical. At such time it is necessary to reposition the mobile crushing station 19 by digging a new trench more proximate the mine face, pivoting the pivoting truck skips 80, 110 upwardly, lifting the stability jack assemblies 103, 103*b* upwardly and driving the mobile crushing station 19 to be positioned in the new trench, whereupon the jacks and skips are repositioned and the receipt of material and crushing of that material is recommenced.

In providing embodiments of our mobile crushing stations, it may be:

It should be appreciated that the mobile crushing station 19 is repositionable under its own power and may be easily and cost effectively repositioned proximate a mine face as the mine face advances with excavation. Preferably, the mobile crushing station 19 is sized and configured to be positioned for operation in a shallow trench relative to trenches required for prior art mobile crushing stations. Therefore, the mobile crushing station 19 can increase the efficiency of mining operations and be relatively inexpensive to relocate. Preferably, the mobile crushing station 19 does not require disassembly to relocate, which also reduces the expense of relocating the mobile crushing station and also increases the efficiency of a mining operation.

The mobile crushing station 19 can include a plurality of spacedly arrayed crawler track assemblies for mobility, maneuverability, stability and weight distribution. The mobile crushing station 19 is preferably sized and configured to have its weight dispersed to facilitate the use of smaller car body type crawler track assemblies.

The mobile crushing station 19 can be sized and configured to use two spaced apart opposing low rise earthen ramps for vehicle access to the truck skips. The truck skips may be pivotable or rotatable. Each pivoting truck skip can be independently operable.

The mobile crushing station 19 can also have two pivoting truck skips on opposing sides providing two dump locations for material carrying vehicles, such as dump trucks or other material carrying or material transporting devices. The mobile crushing station 19 can include truck skips with hinged floors. A portion of the hinged floor can act as a back up stop for the rear wheels of an earth moving vehicle. The hinged skip floors can be configured to become more linearly aligned as the skips are pivoted upwardly.

The mobile crushing station 19 may be configured to significantly reduce the lift height of each pivoting truck skip. The frame of the mobile crushing station may be configured to lower the center of gravity and be designed to minimize the mass and size of components to help keep the cost of the station as low as possible without detracting from the reliability or effectiveness of the apparatus.

The mobile crushing station 19 can include spacedly arrayed pivoting outboard stability jacks. The stability jacks can help support the skips when the skips are in a bottom position to receive material from material carrying vehicles.

The mobile crushing station 19 may have a diverter gate between the pivoting truck skips to regulate material flow onto the apron plate feeder. The diverter gate is preferably positioned within the feed hopper. The diverter gate may be configured to move to adjust the flow of material being received from a truck skip.

The mobile crushing station 19 can include amperage filters on rock crusher motors that detect overloading and automatically slow the apron plate feeder to prevent overloading and providing uninterrupted maximum throughput.

The mobile crushing station 19 can also have a discharge conveyor. The mobile crushing station 19 can also include belt scales that weigh comminuted material for recording production. The belt scales may be positioned on the discharge conveyor or may be connected to the discharge conveyor.

A second present preferred embodiment of a mobile crushing station 201 is shown in FIGS. 12-17. The mobile crushing station 201 includes a base, or frame 205. The frame is attached to jacks 202. The frame 205 is configured to support or interconnect different elements of the mobile crushing station 201, such as first skip 247, second skip 245, feed conveyor 261, operator station 251, hopper 275, crushing device 231, discharge conveyor 213, and storage area 281. The mobile crushing station 201 is preferably sized and configured such that the mobile crushing station 201 is positionable and operational without the need of any excavation of any trench or retaining walls.

The operator station 251 is positioned above the skips and feed conveyor to allow an operator to monitor the activities of the mobile crushing station. The operator station 251 includes various interfaces and actuators that permit the operator to control operations of the mobile crushing station by pressing buttons, entering codes onto a keypad or keyboard, or otherwise providing input to a controller, computer or other device configured to control or actuate a device or component of the mobile crushing station. The operator station 251 may also include telecommunications equipment or signaling equipment for communicating to other workers, other vehicles or personnel located at numerous different locations.

The skips 247 and 245 are positioned on opposite sides of a feed hopper 275. Preferably, the first skip 247 and the second skip 245 are each sized and configured to receive four hundred tons of material. Of course, each skip may be sized and configured to receive less or more material, as may be desired to meet a particular mining operation's preferences or requirements.

The hopper 275 is sized and configured to receive material from the first skip 247 or second skip 245 and guide that material onto a feed conveyor 261, or apron conveyor. The feed conveyor 261 is inclined to move material dumped into the hopper 275 towards the crushing device 231, which may be, for example, a sizer, a crusher, or at least one crushing circuit.

The first skip 247 is attached to a first skip lifting assembly 232, which includes a first member 234 and a second member 235 positioned on opposite sides of the first skip 247. It should be understood that the members may be integral metal beams, metal bunions, metal supports, or may be formed by interconnected beams, supports or trunions. Preferably, the members 234, 235 are composed of steel. The first skip lifting assembly 232 is configured to pivot about member pivots 250 formed on the frame 205 to move the first skip 247 from a first position to a second position. For example, the first skip lifting assembly 232 may be configured to move the first skip 247 from a bottom position to a raised position, or dumping position, as may be appreciated from FIGS. 15 and 16.

Each member 234, 235 of the first skip lifting assembly 232 is attached to a lifting mechanism such as cylinder 240. Cylinder 204 may be, fore example a hydraulic cylinder or gas cylinder. Each cylinder 240 is pivotally coupled to a portion of the frame 205 and is also attached to a portion of a respective member. Each cylinder 240 is configured to move from a retracted position to an extended position to move the members and the first skip 247. Preferably, the pressure for the hydraulic lines of the cylinders 240 is 5,000 pounds per square inch (psi) for skips that are configured to receive, lift and dump four hundred ton of material. The cylinders 240 are pivoted to the frame at pivotal attachments 241 so the cylinders 240 may pivot as they move from a retracted position to an extended position to move the first skip 247. Of course, the cylinders may also move from an extended position to a retracted position to move the members and lower the first skip from a raised position to a lower position.

While in the bottom position, the first skip 247 may be positioned to receive material from an excavation vehicle or dump truck, as may be appreciated from FIGS. 12-14 or FIG. 17. The first skip 247 may then be moved to the dumping position, or second position, as may be seen in FIGS. 15 and 16, to move the excavated material from the skip to the feed hopper 275 and, ultimately, onto the feed conveyor 261 for feeding the material into the crushing device 231.

The first skip 247 may be configured have a bucket-like portion that includes a backstop 248 that is sized and configured to receive a substantial portion of material dumped onto the skip. The bucket-like portion may be sized and configured to hold or retain the material when the skip is moved to ensure the material is properly guided into the feed hopper 275 when the material is dumped into the hopper 275.

The second skip 245 is attached to a second skip lifting assembly 233, which includes a first member 236 and a second member 237 positioned on opposite sides of the second skip 245. As with the members of the first skip lifting assembly 232, the members of the second skip lifting assembly 233 may be integral metal beams, metal trunions, metal supports, or may be formed by interconnected beams, supports or trunions. Preferably, the members 236, 237 are composed of steel. The second skip lifting assembly 233 is configured to pivot about member pivots 250 formed on the frame 205 to move the second skip 245 from a first position to a second position. For example, the second skip lifting assembly 233 may be configured to move such that the second skip 245 is moveable from a bottom position to a raised position, or dumping position.

Each member 236, 237 of the second skip lifting assembly 233 is attached to a lifting mechanism, such as cylinder 240. Cylinders 240 may be hydraulic cylinders or gas cylinders. Each cylinder 240 is pivotally coupled to a portion of the frame 205 and is also attached to a portion of a respective member. Each cylinder 240 is configured to move from a retracted position to an extended position to move the members and the second skip 245. Preferably, the pressure for the hydraulic lines of the cylinders 240 is 5,000 pounds per square inch (psi) for skips that are configured to receive, lift and dump four hundred ton of material. The cylinders 240 are pivoted to the frame at pivotal attachments 241 so the cylinders 240 may pivot as they move from a retracted position to an extended position to move the second skip 245. Of course, the cylinders may also move from an extended position to a retracted position to move the members and lower the second skip from a raised position to a lower position.

While in the bottom position, the second skip 245 may be positioned to receive material from an excavation vehicle or dump truck, as may be appreciated from FIGS. 12-14 or FIG. 17. The second skip 245 may then be moved to the dumping position to move the excavated material from the skip to the feed hopper 275 and, ultimately, onto the feed conveyor 261 for feeding the material into the crushing device 231.

Similarly to the first skip 247, the second skip 245 may be configured have a bucket-like portion that includes a backstop 248 that is sized and configured to receive a substantial portion of material dumped onto the skip. The bucket-like portion may be sized and configured to hold or retain the material when the skip is moved to ensure the material is properly guided into the feed hopper 275 when the material is dumped into the hopper 275.

Preferably, the first and second skips are configured such that an operator must manually actuate the movement of the skips from a bottom position, or material receiving position, to a dumping position. Such actuation may occur from an operator in the operator station 251 manipulating an actuator, such as a button or key pad, to actuate movement of the cylinders 240 to lift a skip after material has been dumped onto the skip.

A controller may be coupled between the actuator and the cylinders to control the movement of the cylinders. For instance, after receiving input from the operator via a button or other input device, the controller may be configured to cause a skip to move to the dumping position and stay in that position for a predetermined period of time. After that time period ends, the controller may then cause the cylinders to lower the skip back to the bottom position to receive more material. Alternatively, the controller may be configured to hold the skip in the dumping position until receiving input from the operator, such as a signal that may be sent to the controller by an operator pressing a button or entering a code. After receiving this new input, the controller may then lower the skip to the bottom position.

Preferably, the mobile crushing station is configured such that only one skip may be raised to the dumping position at a time to dump material into the hopper 275. Such a limit on the movement of skips loaded with material is preferred as a safety precaution. Moreover, such a limit may help prevent frame imbalance, which could lead to tipping of the frame or frame deformation. Such factors are particularly true of skips design to retain and dump hundreds of tons of material at a time.

Figure 20:
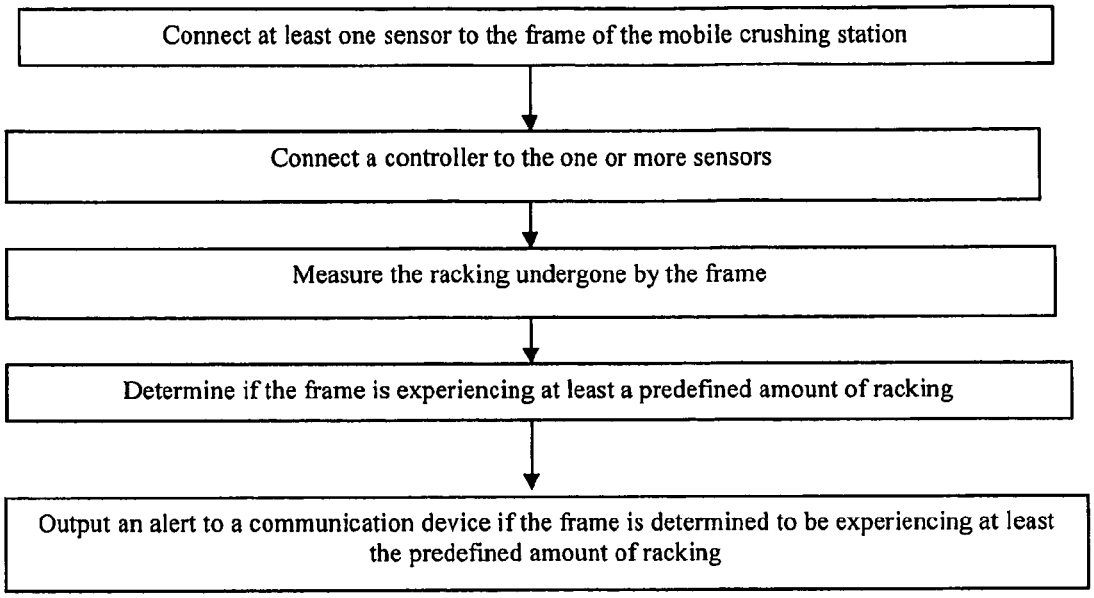
FIG. 20 is a flow chart of a first present preferred method of monitoring frame racking of a mobile crushing station.

Inclinometers, or clinometers, may be attached to portions of the frame or other portions of the mobile crushing station. The inclinometers are preferably positioned at four corners of the frame of the mobile crushing station. The inclinometers may be considered tilt meters or tilt indicators and are preferably configured to measure the tilt, slope, or angle of a portion of the frame 205. The inclinometers may be coupled to a controller configured to determine whether the measurements provided by the inclinometers indicate that the frame needs maintenance or improperly positioned such that the frame is not sufficiently balanced. The controller may also be configured to determine racking based on the information sensed by the inclinometers. It should be understood that the racking of the frame may result from the significant stress or strain the frame may undergo during operations. One present preferred method of determining whether a predefined racking condition exists is shown in FIG. 20.

Figure 19:
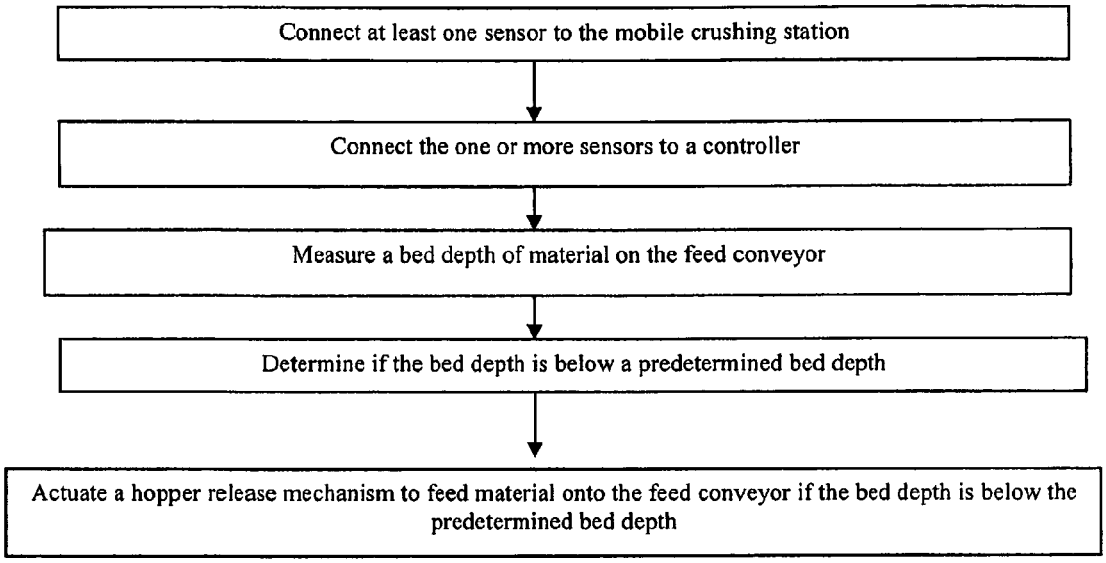
FIG. 19 is a flow chart of a first present preferred method of controlling feed conveyor bed depth of a mobile crushing station.

Sensors are also attached to the frame or other components to measure the bed depth of the feed conveyor 261. The bed depth is monitored to ensure that material is preferably always positioned on the feed conveyor to minimize wear. The sensors may be coupled to a controller configured to receive input from the sensors and determine when a portion of the feed conveyor is not at a predetermined sufficient bed depth. After making such a determination, the controller may be configured to issue an alert to a display device or other signaling device to signal to an operator that the bed depth is not at a sufficient level. A present preferred method of monitoring bed depth may be appreciated from FIG. 19.

Figure 22:
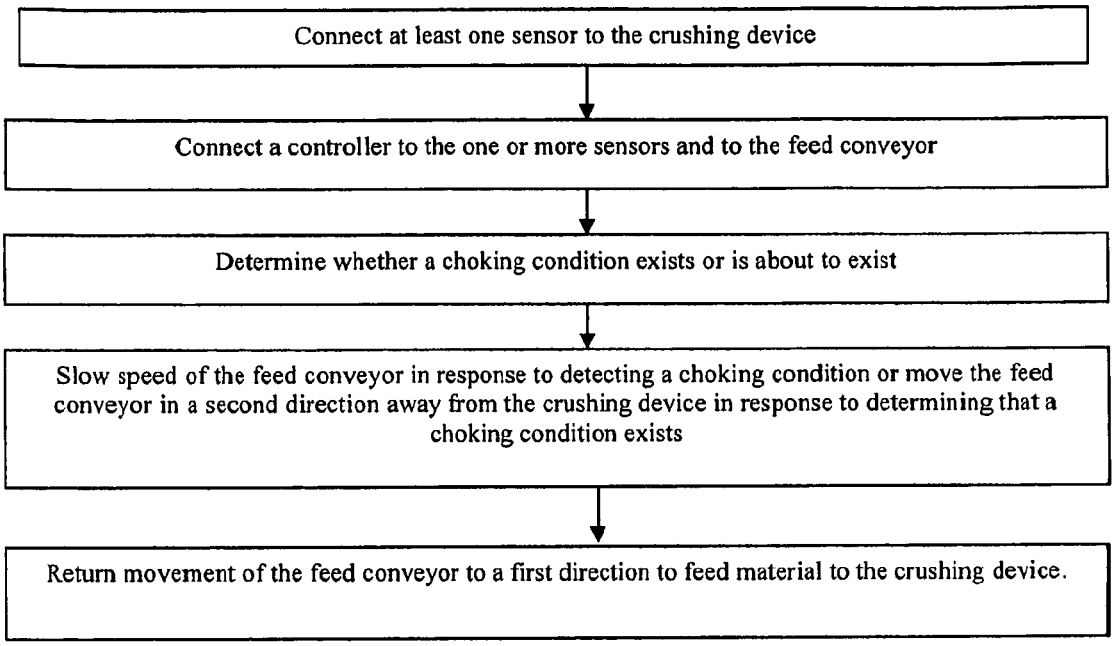
FIG. 22 is a flow chart of a first present preferred method of determining whether a choking condition exists and adjusting the movement of the feed conveyor in response to detecting a choking condition.

Sensors may also be attached adjacent to the feed opening of the crushing device that is sized and positioned to receive material from the feed conveyor 261. The sensors may be positioned on the housing adjacent to the feed opening or may be positioned on a crushing mechanism of the crushing device positioned between the feed opening and the discharge opening. The sensors may be configured to sense how much material is passing through the crushing device 231. A controller may be coupled to the sensors and be configured to determine when material is becoming trapped in the opening of the crushing device, or choked. After determining that a choking condition exists or that a predetermined low feed rate exists that suggests a choking condition exists or is about to exist, the controller may be configured to cause the feed conveyor to move away from the feed opening of the crushing device 231 and subsequently move back toward the opening. Such a sequence of movements may occur a predetermined number of times in an attempt to jostle material and alleviate the choking condition that was detected. After a predetermined number of back and forth movements of the feed conveyor, the controller may then be configured to proceed with normal operating conditions. A present preferred method of resolving choking conditions may be appreciated from FIG. 22.

The controller may also be configured to issue an alert to an operator in the operator station 251 upon detecting a choke condition. The controller may be configured to take no further action until receiving input from the operator via an input device, such as a key pad entry or button actuation.

The controller may also be configured to activate and deactivate the feed conveyor to help limit choking condition. Sensors attached to the crushing device that are also coupled to the controller may measure material being fed into the crushing device and may also be positioned to sense material exiting the crushing device via a discharge orifice. The controller may be configured to determine when to actuate the feed conveyor for feeding material to the crushing device based on a predetermined feed rate or to ensure material is being fed to the crushing device within preset feed rate limits.

Figure 21:
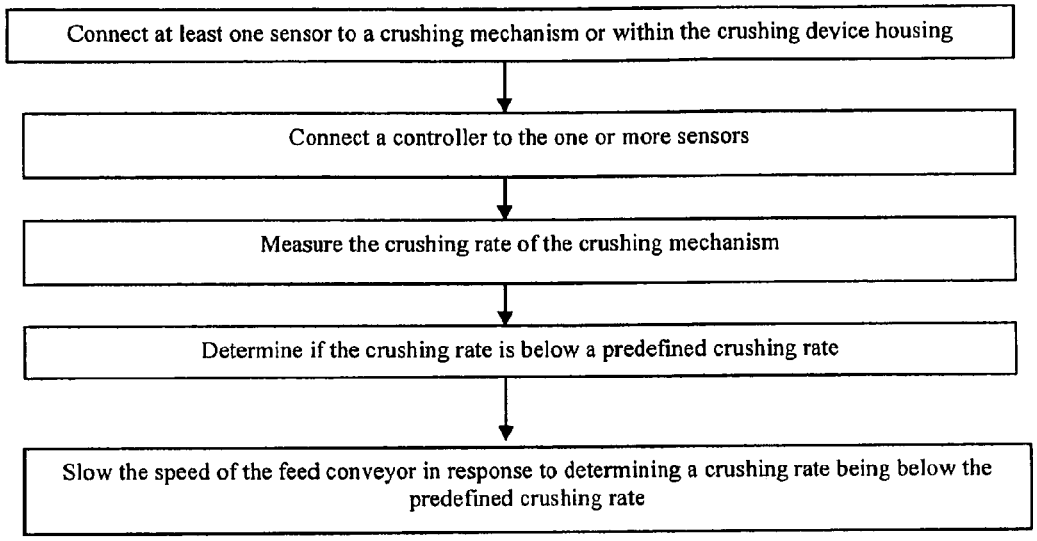
FIG. 21 is a flow chart of a first present preferred method of determining when to slow the feed rate of material to the crushing device.

The mobile crushing station 201 can include amperage filters or other sensors on rock crusher motors or other components of the crushing mechanisms of the crushing device 231. The sensors may be configured to detect overloading. When overloading is detected, a controller coupled to the sensor may be configured to slow the feed conveyor to prevent overloading and provide uninterrupted maximum throughput. A present preferred method of determining whether the feed rate needs to be slowed as a result of a slowed crushing rate that may be measured by such amperage filters or other sensors may be appreciated from FIG. 21.

Figure 18:
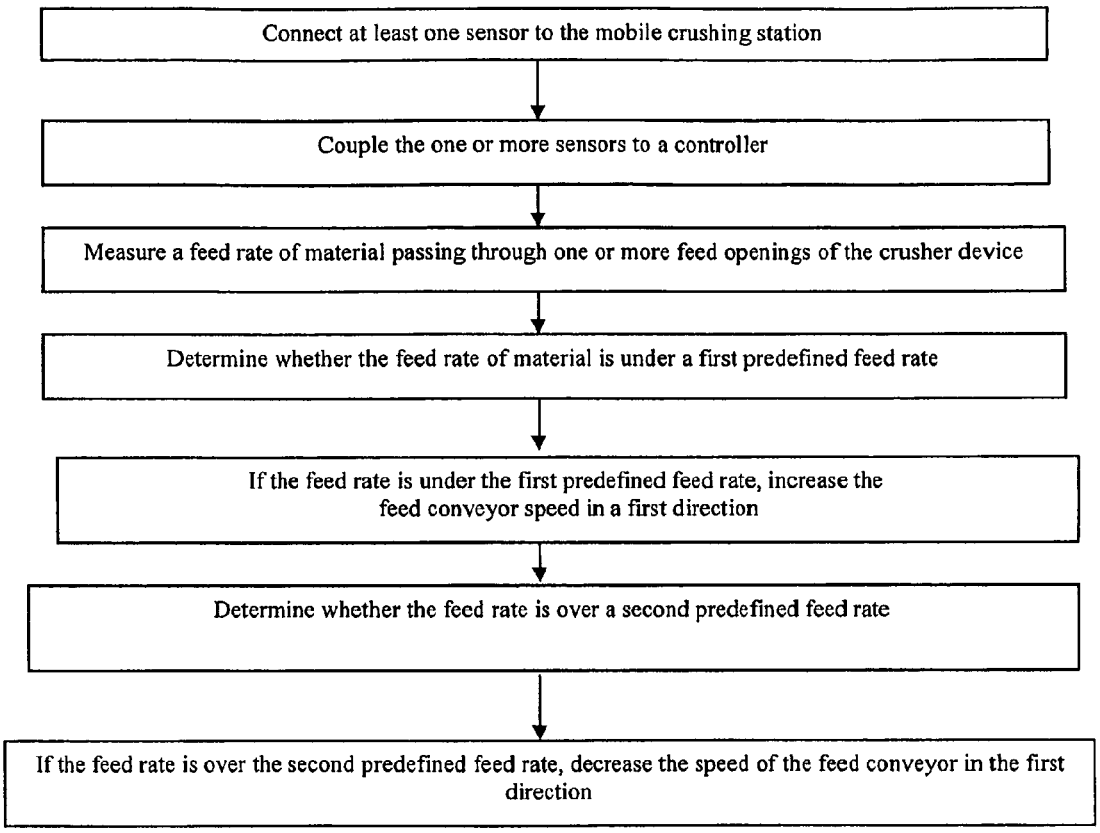
FIG. 18 is flow chart of a first present preferred method of controlling feed rate to the crusher device of a mobile crushing station.

A present preferred method of monitoring feed rates to the crushing device 231 may be appreciated from FIG. 18.

The jacks 202 may be configured to move from a first position to a second position. For instance, the jacks may move from a retracted position to an extended position, as may be appreciated from FIG. 17. Jacks 202 may be moved to the extended position to raise the height of the frame and provide spacing between the frame and the ground such that a lifting mechanism may be positioned under the frame 205 to lift the frame to move the frame.

The second present preferred embodiment of the mobile crushing station 201 may also include a moveable diverter gate connected to the feed hopper 271. The moveable gate may be tiltable to divert or guide material through the hopper and onto the feed conveyor.

It should be appreciated that the crushing device 231 may include a grizzly. The grizzly may be positioned adjacent to the feed opening of the crushing device 231 and may be sized and configured to control the size of material fed into the crushing device 231.

The feed hopper 271 may include a release mechanism that is sized and configured to move from a first position to a closed position. When the release mechanism is in the first position, the feed hopper 271 may be configured to retain material fed into the hopper. When the release mechanism is moved to the second position, the material retained within the hopper may pass through the hopper and onto the feed conveyor. The release mechanism of the hopper 271 may be coupled to a controller. The controller may be configured to actuate movement of the release mechanism upon receiving input from an actuation device or input device, such as a button or key pad connected to the controller.

Alternatively, the controller may be configured to receive input from one or more sensors and determined when a predetermined release condition occurs. After determining that a release condition occurs, the controller may send a signal to the release mechanism of the hopper to cause the release mechanism to move to the second position so that material is fed onto the feed conveyor.

The mobile crushing station 201 may be connected to a generator, power grid, or other power supply. The power supply may be distal from the mobile crushing station. Alternatively, it is contemplated that a motor, engine or powering device may be coupled to the frame and configured to transmit power to the mobile crushing station.

Of course, other variations to the mobile crushing station 201 may be made. For instance, the skip lifting assemblies may be configured to include interconnected articulated members that all move synchronously when lifting a skip from a bottom position to a dumping position. As another example, tracks may be connected to the frame. One or more of the tracks may be pivotally connected to the frame. As yet another example, the mobile crushing station 201 may include one or more controllers or a plurality of interconnected controllers that are coupled to sensors, input devices and communication devices. The communication devices may be display assemblies such as monitors or may be speakers or loudspeakers. Each controller may be configured to monitor or control a particular function. Alternatively, one or more controllers may be configured to monitor or control multiple functions.

It should be appreciated that embodiments of the mobile crushing station 201 may be positioned relatively close to a mining or other excavation project. As material is excavated, vehicles or other devices may transport the excavated material to the skips of the mobile crushing station. After a skip is considered to be fully loaded with material, the skip is moved to a dumping position to feed the material into the hopper. Movement of the skip is preferably actuated by an operator in the operator station of the mobile crushing station. The material fed into the hopper is subsequently fed onto the feed conveyor for feeding to the crushing device. After the material is crushed by the crushing device, the discharge conveyor transports the crushed material to another location. That location may be another conveyor or may be a transport vehicle or other material transport device.

Preferably, the mobile crushing station is configured for use on relatively flat ground, which does not need to be excavated to form a trench. Of course, other embodiments of the mobile crushing station may be sized and configured for use and positioning on a substantially flat area, which may require little or no trenching or other work to form or may be configured for use and positioning within very shallow trenches that require relatively little excavation work.

After excavation has proceeded sufficiently for the distance between the mobile crushing station and the excavation work to require an inefficient amount of time for transporting material to the mobile crushing station, the mobile crushing station may be relocated or repositioned closer to the excavation activities. Since significantly less preparation work, if any preparation work, is required to prepare the new location for the mobile crushing station, the repositioning of the mobile crushing station can be much more efficient than prior art mobile crushing stations and require significantly less costs to be incurred by a mining or excavation operator.

While certain present preferred embodiments of mobile crushing stations and methods of making and using the same have been shown and described above, it is to be distinctly understood that the invention is not limited thereto but may be otherwise variously embodied and practiced within the scope of the following claims.

What is claimed is:

1. A mobile crushing station comprising:

a frame;

at least one skip, the at least one skip comprising a first skip;

at least one skip lifting assembly moveably connected to the frame, the at least one skip lifting assembly comprising a first skip lifting assembly connected to the first skip, the first skip lifting assembly configured to move relative to the frame to move the first skip from a first position to a second position;

the first skip sized and configured to receive material from a dump truck, the first skip having a body that defines a floor and a plurality of sidewalls adjacent to the floor, a first portion of the sidewalls and a first portion of the floor defining a material receiving portion of the first skip that is sized and configured to receive material and retain material until the first skip is moved to the second position, the floor of the first skip also having a second portion that at least partially defines at least one truck stop, the second portion of the floor also being sized and configured to support wheels of the dump truck when the first skip is in the first position such that material is dumpable into the material receiving portion of the first skip by the dump truck while wheels of the dump truck are positioned on the floor of the first skip adjacent to the at least one truck stop of the first skip;

a plurality of first cylinders moveably connected to the frame and connected to the first skip lifting assembly, each first cylinder configured to move from a retracted position to an extended position so that movement of the first cylinders to the extended position moves the first skip lifting assembly such that the first skip moves to the second position;

a hopper connected to the frame adjacent to the first skip, the hopper having an upper opening sized and configured to receive material from the first skip;

a feed conveyor connected to the frame adjacent to the hopper, the feed conveyor sized and configured to receive material from the hopper, the feed conveyor being moveable in a first direction to transport material in the first direction;

a crushing device connected to the frame adjacent to the feed conveyor, the crushing device having a housing, the housing of the crushing device having at least one feed opening sized and configured to receive material from the feed conveyor and at least one discharge opening sized and configured to permit material to pass through the at least one discharge opening, the crushing device having at least one crushing mechanism attached to the housing between the at least one feed opening and the at least one discharge opening such that material passing through the at least one feed opening is crushed by the crushing mechanism before the material passes through the at least one discharge opening; and a discharge conveyor connected to the frame adjacent to the crushing device, a portion of the discharge conveyor being below the crushing device to receive material from the at least one discharge opening of the crushing device.

2. The mobile crushing station of claim 1 wherein the at least one skip further comprising a second skip; and the at least one skip lifting assembly further comprising a second skip lifting assembly moveably connected to the frame and connected to the second skip;

the second skip lifting assembly configured to move relative to the frame to move the second skip from a first position to a second position, the second skip sized and configured to receive material, the second skip being comprised of a body that defines a floor and a plurality of sidewalls adjacent to the floor, a first portion of the sidewalls and a first portion of the floor defining a material receiving portion of the second skip that is sized and configured to receive material and retain material until the second skip is moved to the second position, the floor of the second skip also having a second portion that at least partially defines at least one truck stop, the second portion of the floor also being sized and configured to support wheels of a dump truck when the second skip is in the first position such that material is dumpable into the material receiving portion of the second skip by the dump truck while wheels of the dump truck are positioned on the floor of the second skip and adjacent to the at least one truck stop of the second skip; and a plurality of second cylinders moveably connected to the frame and connected to the second skip lifting assembly, each second cylinder configured to move from a retracted position to an extended position such that movement of the second cylinders to the extended position moves the second skip lifting assembly so that the second skip moves to the second position.

3. The mobile crushing station of claim 2 wherein the first skip has a first side and a second side opposite the first side and the first skip lifting assembly is comprised of a first member and a second member, the first member of the first skip lifting assembly having a first end pivoted to the frame and a second end that is attached to a portion of the first skip adjacent to the first side of the first skip, the second member of the first skip lifting assembly having a first end pivoted to the frame and a second end that is attached to a portion of the first skip adjacent to the second side of the first skip; and wherein the second skip has a first side and a second side opposite the first side and the second skip lifting assembly is comprised of a first member and a second member, the first member of the second skip lifting assembly having a first end pivoted to the frame and a second end that is attached to a portion of the second skip adjacent to the first side of the second skip, the second member of the second skip lifting assembly having a first end pivoted to the frame and a second end that is attached to a portion of the second skip adjacent to the second side of the second skip.

4. The mobile crushing station of claim 2 further comprising an operator station connected to the frame such that the operator station is positioned above the first skip and the second skip when the first and second skips are in the first position.

5. The mobile crushing station of claim 1 wherein the at least one truck stop is configured as a wheel stop by the second portion of the floor of the first skip that at least partially defines the at least one truck stop being more steeply angled relative to horizontal than the second portion of the floor of the first skip that supports the wheels of the dump truck when the dump truck is moved adjacent to the at least one truck stop for dumping material into the material receiving portion of the first skip.

6. The mobile crushing station of claim 1 wherein the crushing device is also comprised of at least one grizzly positioned adjacent to the at least one feed opening.

7. The mobile crushing station of claim 1 further comprising at least one controller coupled to at least one input device and the first cylinders, the at least one controller configured to actuate movement of at least one of the first cylinders after receiving lifting input from the input device.

8. The mobile crushing station of claim 1 further comprising inclinometers connected to the frame, at least one controller connected to the inclinometers, and at least one communication device connected to the at least one controller, the at least one controller configured to determine whether the frame is undergoing a predefined amount of racking and, if the at least one controller determines that the frame is experiencing at least the predefined amount of racking, the at least one controller is configured to output an alert to the at least one communication device to notify an operator.

9. The mobile crushing station of claim 1 comprising at least one sensor positioned adjacent to the at least one feed opening of the crushing device, at least one controller coupled to the at least one sensor and the feed conveyor, the at least one sensor configured to measure a feed rate of material passing through the at least one feed opening, the at least one controller configured to determine whether the feed rate of material is under a first predefined feed rate amount and to increase feed conveyor speed in the first direction when the feed rate is determined to be below the first predefined feed rate amount.

10. The mobile crushing station of claim 9 wherein the at least one controller is also configured to determine whether the feed rate of material is over a second predefined feed rate amount and is configured to decrease feed conveyor speed in the first direction when the feed rate is determined to be above the second predefined feed rate amount.

11. The mobile crushing station of claim 10 wherein the feed conveyor is also moveable in a second direction that is opposite the first direction and the at least one controller is configured to determine whether a predefined choking condition exists based on measurements received from the at least one sensor, the at least one controller configured to cause the feed conveyor to move in the second direction for a predefined period of time when the predefined choking condition is determined to exist.

12. The mobile crushing station of claim 1 further comprising a moveable grate connected to at least one of the frame and the hopper.

13. The mobile crushing station of claim 1 a plurality of jacks connected to the frame, the jacks configured to move from a retracted position to an extended position.

14. The mobile crushing station of claim 1 wherein the mobile crushing station is sized and configured to be moved from a first location to a second location by a transport mechanism, the transport mechanism sized and configured to lift and move the mobile crushing station, push the mobile crushing station, or pull the mobile crushing station to the second location.

15. The mobile crushing station of claim 1 further comprising a plurality of tracks pivotally connected to the frame and wherein the frame is a chassis.

16. A mobile crushing station comprising:

a frame;

a first skip;

a first skip lifting assembly moveable connected to the frame and connected to the first skip, the first skip lifting assembly configured to move relative to the frame to move the first skip from a first position to a second position, the first skip sized and configured to receive material;

the first skip sized and configured to receive material from a dump truck, the first skip having a body that defines a floor and a plurality of sidewalls adjacent to the floor, a first portion of the sidewalls and a first portion of the floor defining a material receiving portion of the first skip that is sized and configured to receive material and retain material until the first skip is moved to the second position, the floor of the first skip also having a second portion that at least partially defines at least one truck stop, the second portion of the floor also being sized and configured to support wheels of the dump truck when the first skip is in the first position such that material is dumpable into the material receiving portion of the first skip by the dump truck while wheels of the dump truck are on the floor of the first skip and adjacent to the at least one truck stop of the first skip;

a plurality of first lifting mechanisms moveably connected to the frame and connected to the first skip lifting assembly, each first lifting mechanism configured to move from a first position to a second position so that movement of the first lifting mechanisms to the second position moves the first skip lifting assembly such that the first skip moves to the second position of the first skip;

a hopper connected to the frame adjacent to the first skip and the second skip, the hopper having an upper opening sized and configured to receive material from the first skip;

a feed conveyor connected to the frame adjacent to the hopper, the feed conveyor sized and configured to receive material from the hopper, the feed conveyor being moveable in a first direction to transport material in the first direction;

a crushing device connected to the frame adjacent to the feed conveyor, the crushing device having a housing, the housing of the crushing device having at least one feed opening sized and configured to receive material from the feed conveyor and at least one discharge opening sized and configured to permit material to pass through the at least one discharge opening, the crushing device having at least one crushing mechanism attached to the housing between the at least one feed opening and the at least one discharge opening such that material passing through the at least one feed opening is crushed by the crushing mechanism before the material passes through the at least one discharge opening; and a discharge conveyor connected to the frame adjacent to the crushing device, a portion of the discharge conveyor being positioned to receive material from the at least one discharge opening of the crushing device.

17. The mobile crushing station of claim 16 comprising at least one sensor positioned adjacent to the at least one feed opening of the crushing device, at least one controller coupled to the at least one sensor and the feed conveyor, the at least one sensor configured to measure a feed rate of material passing through the at least one feed opening, the at least one controller configured to determine whether the feed rate of material is under a first predefined feed rate amount and to increase feed conveyor speed in the first direction when the feed rate is determined to be below the first predefined feed rate amount and wherein the at least one controller is also configured to determine whether the feed rate of material is under a second predefined feed rate amount and is configured to decrease feed conveyor speed in the first direction when the feed rate is determined to be above the second predefined feed rate amount.

18. The mobile crushing station of claim 16 wherein the at least one truck stop is configured as a wheel stop by the second portion of the floor of the first skip that at least partially defines the at least one truck stop being more steeply angled relative to horizontal than the second portion of the floor of the first skip that supports the wheels of the dump truck when the dump truck is moved adjacent to the at least one truck stop for dumping material into the material receiving portion of the first skip.

19. The mobile crushing station of claim 16 also comprising at least one sensor positioned adjacent to the hopper and at least one controller coupled to the at least one sensor, and wherein the hopper is comprised of a hopper release mechanism, the hopper release mechanism coupled to the at least one controller, the at least one sensor configured to measure a bed depth of material positioned on the feed conveyor, the at least one controller configured to determine when the bed depth is below a predefined bed depth and is configured to actuate the hopper release mechanism after determining that the bed depth is below the predefined bed depth, actuation of the hopper release mechanism permitting material stored in the hopper to pass through an opening of the hopper and onto the feed conveyor.

20. The mobile crushing station of claim 16 also comprising at least one sensor connected to the at least one crushing mechanism and at least one controller coupled to the at least one sensor and to the feed conveyor, the at least one controller configured to determine when a predefined slow crushing condition exists, the at least one controller configured to reduce feed conveyor speed in the first direction if the predefined slow crushing condition exists.

* * * * *